US009517385B2

(12) United States Patent
Okabe et al.

(10) Patent No.: US 9,517,385 B2
(45) **Date of Patent: *Dec. 13, 2016**

(54) GOLF BALL AND PROCESS FOR PREPARING THE SAME

(75) Inventors: Satoko Okabe, Kobe (JP); Keiji Ohama, Kobe (JP); Takahiro Shigemitsu, Kobe (JP)

(73) Assignee: DUNLOP SPORTS CO., LTD., Kobe-Shi (JP)

( * ) Notice: Subject to any disclaimer, the term of this patent is extended or adjusted under 35 U.S.C. 154(b) by 311 days.

This patent is subject to a terminal disclaimer.

(21) Appl. No.: 12/647,122

(22) Filed: Dec. 24, 2009

(65) Prior Publication Data

US 2010/0167841 A1 Jul. 1, 2010

(30) Foreign Application Priority Data

Dec. 26, 2008 (JP) ..... 2008-335261
Dec. 26, 2008 (JP) ..... 2008-335265

(51) Int. Cl.
*A63B 37/04* (2006.01)
*A63B 37/00* (2006.01)
*A63B 45/00* (2006.01)

(52) U.S. Cl.
CPC ..... *A63B 37/0003* (2013.01); *A63B 37/004* (2013.01); *A63B 37/0039* (2013.01); *A63B 37/0075* (2013.01); *A63B 45/00* (2013.01)

(58) Field of Classification Search
USPC ..... 473/371, 374, 376
See application file for complete search history.

(56) References Cited

U.S. PATENT DOCUMENTS 5,047,478 A 9/1991 Ohmae et al.
5,091,478 A 2/1992 Saltman
(Continued)

FOREIGN PATENT DOCUMENTS

JP 60-60867 A 4/1985
JP 62-22841 A 1/1987
(Continued)

OTHER PUBLICATIONS efunda.com, Properties of Polyamide—Nylon 12, Aug. 7, 2013, eunda.com, pp. 1-2.*
(Continued)

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

An object of the present invention is to provide a golf ball providing a great distance. Another object of the present invention is to provide a golf ball striking a balance between a flight distance on a driver shot and an approach performance on an approach shot while providing an excellent shot feeling. The present invention provides a golf ball comprising: a center, a cover and at least one intermediate layer disposed between the center and the cover, wherein at least one piece or one layer of the intermediate layer is formed from a high fluidity intermediate layer composition that contains (A) a polyamide resin composition having a flexural modulus in a range from 700 MPa to 4,000 MPa; (B) at least one member selected from the group consisting of an ethylene-(meth)acrylic acid binary copolymer, a metal-neutralized product of the binary copolymer, an ethylene-(meth) acrylic acid-(meth)acrylic acid ester ternary copolymer, and a metal-neutralized product of the ternary copolymer, and (C) a fluidity improving agent.

11 Claims, 5 Drawing Sheets

(56) References Cited

U.S. PATENT DOCUMENTS

| | | | | |
|---|---|---|---|---|
| 5,176,952 | A | 1/1993 | Joseph et al. | |
| 5,210,138 | A | 5/1993 | Yamamoto et al. | |
| 5,288,242 | A | 2/1994 | Muzslay | |
| 5,587,236 | A | 12/1996 | Agrawal et al. | |
| 5,605,968 | A | 2/1997 | Egashira et al. | |
| 5,656,695 | A | 8/1997 | Endo et al. | |
| 5,713,802 | A | 2/1998 | Moriyama et al. | |
| 5,789,021 | A | 8/1998 | Dooms et al. | |
| 5,820,486 | A | 10/1998 | Tanaka et al. | |
| 5,886,103 | A | 3/1999 | Bellinger et al. | |
| 5,889,114 | A | 3/1999 | Statz | |
| 5,919,862 | A | 7/1999 | Rajagopalan | |
| 5,976,034 | A | 11/1999 | Kato et al. | |
| 6,045,460 | A | 4/2000 | Hayashi et al. | |
| 6,187,864 | B1 | 2/2001 | Rajagopalan | |
| 6,274,669 | B1 | 8/2001 | Rajagopalan | |
| 6,284,840 | B1 * | 9/2001 | Rajagopalan | A63B 37/0003 473/354 |
| 6,353,058 | B1 | 3/2002 | Rajagopalan | |
| 6,468,169 | B1 | 10/2002 | Hayashi et al. | |
| 6,486,250 | B1 * | 11/2002 | Rajagopalan | C08L 77/00 473/354 |
| 6,702,694 | B1 | 3/2004 | Watanabe | |
| 6,762,244 | B2 * | 7/2004 | Rajagopalan | A63B 37/0003 473/373 |
| 6,800,690 | B2 | 10/2004 | Rajagopalan et al. | |
| 6,966,849 | B2 | 11/2005 | Kato | |
| 7,375,151 | B2 * | 5/2008 | Statz | C08K 5/098 473/372 |
| 7,393,288 | B2 | 7/2008 | Egashira et al. | |
| 7,393,289 | B2 | 7/2008 | Egashira et al. | |
| 2002/0013413 | A1 | 1/2002 | Bellinger et al. | |
| 2002/0098915 | A1 | 7/2002 | Cavallaro et al. | |
| 2002/0147280 | A1 | 10/2002 | Rajagopalan | |
| 2003/0104879 | A1 | 6/2003 | Iwami | |
| 2004/0029648 | A1 | 2/2004 | Kato | |
| 2004/0053706 | A1 * | 3/2004 | Kennedy, III | A63B 37/0003 473/351 |
| 2004/0116211 | A1 * | 6/2004 | Sullivan | A63B 37/0003 473/374 |
| 2004/0121856 | A1 | 6/2004 | Iwami | |
| 2004/0142770 | A1 | 7/2004 | Watanabe | |
| 2004/0209708 | A1 | 10/2004 | Bulpett et al. | |
| 2004/0235587 | A1 | 11/2004 | Sullivan et al. | |
| 2006/0063893 | A1 | 3/2006 | Rajagopalan | |
| 2006/0116220 | A1 | 6/2006 | Ohama et al. | |
| 2006/0270492 | A1 | 11/2006 | Higuchi et al. | |
| 2006/0293121 | A1 | 12/2006 | Egashira et al. | |
| 2007/0049419 | A1 | 3/2007 | Egashira et al. | |
| 2007/0111823 | A1 * | 5/2007 | Higuchi | A63B 37/0043 473/371 |
| 2007/0142128 | A1 * | 6/2007 | Watanabe | A63B 37/0003 473/371 |
| 2007/0238552 | A1 * | 10/2007 | Kim | A63B 37/0003 473/371 |
| 2007/0281802 | A1 * | 12/2007 | Watanabe | A63B 37/0003 473/371 |
| 2007/0281804 | A1 | 12/2007 | Kamino et al. | |
| 2008/0076604 | A1 * | 3/2008 | Watanabe | A63B 37/0062 473/371 |
| 2008/0161131 | A1 * | 7/2008 | Ladd | A63B 37/0003 473/376 |
| 2008/0161133 | A1 * | 7/2008 | Sullivan | A63B 37/0003 473/376 |
| 2008/0220900 | A1 * | 9/2008 | Komatsu | A63B 37/0003 473/373 |
| 2008/0227569 | A1 | 9/2008 | Egashira et al. | |
| 2008/0242447 | A1 | 10/2008 | Egashira et al. | |
| 2008/0254914 | A1 * | 10/2008 | Manami | A63B 37/0003 473/373 |
| 2009/0270203 | A1 | 10/2009 | Okabe | |
| 2009/0280927 | A1 | 11/2009 | Sullivan et al. | |
| 2010/0009776 | A1 | 1/2010 | Okabe et al. | |
| 2010/0093466 | A1 | 4/2010 | Ohama et al. | |
| 2010/0167841 | A1 | 7/2010 | Okabe et al. | |
| 2010/0167842 | A1 | 7/2010 | Okabe | |
| 2011/0237348 | A1 | 9/2011 | Okabe | |

FOREIGN PATENT DOCUMENTS

| | | | |
|---|---|---|---|
| JP | 63-146928 | A | 6/1988 |
| JP | 2-51544 | A | 2/1990 |
| JP | 3-64343 | A | 3/1991 |
| JP | 6-145486 | A | 5/1994 |
| JP | 9-38238 | A | 2/1997 |
| JP | 9-248351 | A | 9/1997 |
| JP | 10-179802 | A | 7/1998 |
| JP | 10-314341 | A | 12/1998 |
| JP | 10-328326 | A | 12/1998 |
| JP | 2001-509204 | T | 7/2001 |
| JP | 2001-514561 | A | 9/2001 |
| JP | 2003-48286 | A | 2/2003 |
| JP | 2003-504089 | A | 2/2003 |
| JP | 2003-111870 | A | 4/2003 |
| JP | 2003-159351 | A | 6/2003 |
| JP | 2004-59656 | A | 2/2004 |
| JP | 2004-75776 | A | 3/2004 |
| JP | 2004-97802 | A | 4/2004 |
| JP | 2004-130072 | A | 4/2004 |
| JP | 2004-187991 | A | 7/2004 |
| JP | 2004-188207 | A | 7/2004 |
| JP | 2004-305754 | A | 11/2004 |
| JP | 2005-112990 | A | 4/2005 |
| JP | 2006-326301 | A | 12/2006 |
| JP | 2007-000622 | | 1/2007 |
| JP | 2007-61605 | A | 3/2007 |
| JP | 2008-69463 | A | 3/2008 |
| JP | 2009-261792 | A | 11/2009 |
| JP | 2010-17414 | A | 1/2010 |
| WO | WO 99/08756 | A1 | 2/1999 |

OTHER PUBLICATIONS

Dupont, "Surlyn resins Product Data Sheer", DuPont Packaging & Industrial Polymers, Jan. 7, 2010, p. 1-3.

English translation of the Japanese Office Action dated Apr. 19, 2011, for Application No. 2008-335262.

English translation of the Japanese Office Action dated Dec. 27, 2011 for Application No. 2008-264249.

English translation of the Japanese Office Action dated Jan. 17, 2012 for Application No. 2008-335265.

English translation of the Japanese Office Action dated Jan. 17, 2012, for Application No. 2008-335261.

English translation of the Japanese Office Action dated Jan. 17, 2012, for Application No. 2008-335262.

English translation of the Japanese Office Action dated Mar. 22, 2011, for Application No. 2008-264249.

Japanese Office Action including the English translation dated Feb. 21, 2012, for Application No. 2008-117574.

U.S. Office Action dated Nov. 3, 2011, for U.S. Appl. No. 12/498,138.

U.S. Office Action dated Oct. 20, 2011, for U.S. Appl. No. 12/425,746.

Notice of Reasons for Rejection dated Apr. 19, 2011 for Japanese Application No. 2008-335261.

Notice of Reasons for Rejection dated Apr. 19, 2011 for Japanese Application No. 2008-335265.

English translation of a Japanese Office Action for Japanese Application No. 2008-181892 dated Aug. 28, 2012.

English translation of a Questioning for Japanese Application No. 2008-335265 dated Jul. 30, 2012.

US Office Action of U.S. Appl. No. 12/498,138 dated Apr. 11, 2012.

Japanese Office Action with English Translation dated May 15, 2012 for Application No. 2008-117574.

English translation of Japanese Decision of Refusal and Decision to Dismiss an Amendment dated Jun. 12, 2012 for Japanese Application No. 2008-335261.

English translation of Japanese Decision of Refusal and Decision to Dismiss an Amendment dated Jun. 12, 2012 for Japanese Application No. 2008-335262.

(56) References Cited

OTHER PUBLICATIONS

Office Action dated Jun. 13, 2012 for U.S. Appl. No. 12/574,462.
Office Action dated Jun. 13, 2012 for U.S. Appl. No. 12/647,127.
Thain, "Science and Golf IV, Proceedings of the World Scientific Congress of Golf," 2002, pp. 319-327.
English translation of the Japanese Office Action dated Jul. 10, 2012, for Japanese Application No. 2009-140164.
Japanese Office Action for Japanese Application No. 2008-335261 dated Feb. 27, 2013 with English translation.
Japanese Office Action for Japanese Application No. 2008-335262 dated Feb. 27, 2013 with English translation.
Japanese Office Action for Japanese Application No. 2008-335265 dated Feb. 26, 2013 with English translation.
English translation of an Office Action for Japanese Application No. 2010-073290, dated Apr. 2, 2013.
English Translation of Japanese Office Action dated Dec. 11, 2012 for corresponding Application No. 2008-335261.
English Translation of Japanese Office Action dated Dec. 11, 2012 for corresponding Application No. 2008-335262.
English Translation of Japanese Office Action dated Dec. 11, 2012 for corresponding Application No. 2008-335265.
US Office Action for U.S. Appl. No. 13/046,867 dated Sep. 30, 2013.
U.S. Final Office Action dated Jan. 21, 2014 issued in U.S. Appl. No. 13/046,867.

* cited by examiner

GOLF BALL AND PROCESS FOR PREPARING THE SAME

FIELD OF THE INVENTION

The present invention relates to a golf ball providing an excellent flight distance. The present invention also relates to a golf ball striking a balance between a flight distance and an approach performance, while improving a shot feeling.

DESCRIPTION OF THE RELATED ART

Conventionally, in three-piece golf balls and multi-piece golf balls, ionomer resins having a high acid content or ionomer resins having a large degree of neutralization are used in an intermediate layer composition to enhance the rigidity of the intermediate layer, thereby increasing the launch angle and reducing the spin rate. By doing so, golf balls having an improved flight distance are developed.

However, when ionomer resins having a large acid content are used in the intermediate layer composition, there is a problem that the durability of the golf ball deteriorates. Further, when ionomer resins having a large degree of neutralization are used in the intermediate layer composition, there is a problem that the moldability of the intermediate layer composition deteriorates.

For those reasons, there have been proposals of golf balls in which the rigidity of the intermediate layer is enhanced without using such an ionomer resin having a high acid content or a large degree of neutralization. For example, Japanese Patent Publication No. 2001-509204T discloses a use of a compatibilized blend comprising about 4 percent to 95 percent of at least one ionomer resin; about 95 percent to 4 percent of at least one non-ionic polymer; and about 1 to 15 phr, based on 100 parts ionomer resin and non-ionic polymer, of at least one non-carboxylic acid compatibilizer comprising a material selected from the group consisting of functionalized block and graft polymers, oligomers, and mixtures thereof, wherein at least one portion of the non-carboxylic acid compatibilizer is miscible with the at least one ionomer and at least one portion of the non-carboxylic acid compatibilizer is miscible with the at least one non-ionic polymer.

Japanese Patent Publication No. H10-314341 discloses a cover material for the golf ball comprising a rubber modified thermoplastic resin composition, which is obtained by mixing a functionalized rubbery copolymer to a base resin comprising an ionomer resin, a non-ionomer thermoplastic elastomer, or a mixture thereof. Japanese Patent Publication No. 2007-622 A discloses a golf ball material that essentially contains the following components (A) to (C): (A) an ionomer, (B) a resin composition including one or more types selected from a group consisting of diene-based polymers, thermoplastic polymers, and thermosetting polymers; and (C) an acid group-containing thermoplastic resin composition.

SUMMARY OF THE INVENTION

So far, there has been proposed a technology for enhancing the rigidity of the intermediate layer without using such an ionomer resin having a high acid content or a large degree of neutralization. However, in such a conventional technology of enhancing the rigidity as mixing a thermoplastic resin having a high rigidity with an ionomer resin, in order to ensure the fluidity of the intermediate layer composition, the rigidity of the intermediate layer must be lowered. Thus, there is a problem that the spin rate increases when hitting a driver shot. Further since it is impossible to make a thin-walled intermediate layer because of the low fluidity of the intermediate layer composition, the center must be formed to have a smaller diameter, although the center is formed from a rubber composition having a high repulsion. Therefore, there still remains a room for further improvement from the aspect of the flight distance of the golf ball.

The present invention has been made in view of the above circumstances, and an object of the present invention is to provide a golf ball providing a great distance.

Another object of the present invention is to provide a golf ball striking a balance between a flight distance on a driver shot and an approach performance on an approach shot while providing an excellent shot feeling.

The present invention, which has solved the above problems, provides a golf ball comprising:

a center, a cover and at least one intermediate layer disposed between the center and the cover, wherein at least one piece or one layer of the intermediate layer is formed from a high fluidity intermediate layer composition that contains (A) a polyamide resin composition having a flexural modulus in a range from 700 MPa to 4,000 MPa;

(B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer, and (C) a fluidity improving agent.

The present invention also provides a golf ball comprising:

a core having a center and at least one intermediate layer covering the center; and a cover covering the core, wherein at least one piece or one layer of the intermediate layer is formed from a high fluidity intermediate layer composition that contains (A) a polyamide resin composition having a flexural modulus in a range from 700 MPa to 4,000 MPa and a melt flow rate (240° C., 2.16 kg) of 5.0 g/10 min or more, and containing (a-1) a polyamide resin and (a-2) a resin having at least one functional group selected from the group consisting of a hydroxyl group, a carboxyl group, an anhydride group, a sulfonic acid group, and an epoxy group (including a glycidyl group);

(B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer; and (C) a fluidity improving agent.

Namely, since the high fluidity intermediate layer composition of the present invention contains (A) component, (B) component and (C) component, the resilience and the fluidity of the intermediate layer composition are improved. If the intermediate layer is formed from the above intermediate layer composition, the intermediate layer having a high resilience is obtained. As a result, the core is designed to have a high repulsion and a hardness distribution of an outer-hard inner-soft, resulting in a high launch angle and low spin rate when struck with a driver or the like, which gives a great flight distance.

The present invention further provides a golf ball comprising:

an inner core consisting of a center and a surrounding layer covering the center, at least one intermediate layer covering the inner core, and a cover covering the intermediate layer, wherein at least one piece or one layer of the intermediate layer is formed from a high fluidity intermediate layer composition that has a melt flow rate (240° C., 2.16 kg) of 5.0 g/10 min or more and contains;

(A) a polyamide resin composition having a flexural modulus in a range from 700 MPa to 4,000 MPa;

(B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer; and (C) a fluidity improving agent, wherein a surface hardness (H6) of the intermediate layer and a surface hardness (H4) of the inner core satisfy the equation: H6≥H4, and the cover has a slab hardness (H7) of 45 or less in Shore D hardness.

Namely, since the high fluidity intermediate layer composition of the present invention contains (A) component, (B) component and (C) component, the intermediate layer composition having the high resilience and high repulsion and the excellent fluidity is obtained. Use of the above intermediate layer composition enables to produce the intermediate layer having the thin thickness and the excellent repulsion. Further, since the surrounding layer having a lower hardness than the intermediate layer is disposed inside the intermediate layer, the inner core layer and the intermediate layer have the outer-hard inner soft construction to the higher extent. Further, the cover is made to have a lower hardness by using the cover composition having a relatively low hardness. Thus, the golf ball striking a balance between the flight distance on the driver shot and the approach performance on the approach shot while having an excellent shot feeling is obtained.

The present invention further provides a process for producing a golf ball having a core having a center and at least one intermediate layer covering the center and a cover covering the core, comprising, dry blending (A) a polyamide resin composition having a flexural modulus in a range from 700 MPa to 4,000 MPa and a melt flow rate (240° C., 2.16 kg) of 5.0 g/10 min or more, and containing (a-1) a polyamide resin and (a-2) a resin having at least one functional group selected from the group consisting of a hydroxyl group, a carboxyl group, an anhydride group, a sulfonic acid group, and an epoxy group (including a glycidyl group) with (B) at least one member selected from the group consisting of an ethylene-(meth) acrylic acid binary copolymer, a metal-neutralized product of the binary copolymer, an ethylene-(meth)acrylic acid-(meth)acrylic acid ester ternary copolymer, and a metal-neutralized product of the ternary copolymer;

mixing a melt of (C) a fluidity improving agent to an obtained mixture of (A) component and (B) component, while adding (C) the fluidity improving agent in a liquid state to prepare a high fluidity intermediate layer composition by extrusion, forming an intermediate layer from the obtained high fluidity intermediate layer composition; and forming a cover from a cover composition on the intermediate layer.

According to the present invention, a golf ball having a great flight distance is obtained. According to the present invention, a golf ball striking a balance between a flight distance and the approach performance while having an excellent shot feeling is obtained.

DESCRIPTION OF THE PREFERRED EMBODIMENT

Figure 1:
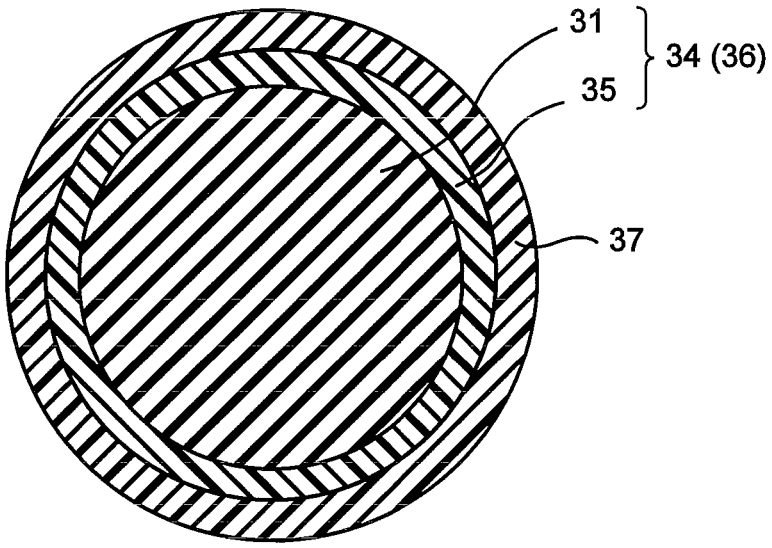
FIG. 1 is an preferable golf ball construction of the present invention.

The present invention provides a golf ball comprising:

a center, a cover and at least one intermediate layer disposed between the center and the cover, wherein at least one piece or one layer of the intermediate layer is formed from a high fluidity intermediate layer composition that contains (A) a polyamide resin composition having a flexural modulus in a range from 700 MPa to 4,000 MPa;

(B) at least one member selected from the group consisting of an ethylene-(meth)acrylic acid binary copolymer, a metal-neutralized product of the binary copolymer, an ethylene-(meth)acrylic acid-(meth) acrylic acid ester ternary copolymer, and a metal-neutralized product of the ternary copolymer, and (C) a fluidity improving agent.

(1) High Fluidity Intermediate Layer Composition

First, the high fluidity intermediate layer composition used in the present invention will be explained.

(A) the polyamide resin composition having a flexural modulus in a range from 700 MPa to 4,000 MPa (hereinafter, sometimes merely referred to as "(A) polyamide resin composition") will be described.

(A) The polyamide resin composition preferably contains (a-1) a polyamide resin and has a flexural modulus in a range from 700 MPa to 4,000 MPa.

(a-1) The polyamide resin contained in (A) the polyamide resin composition will be explained. (a-1) The polyamide resin is not limited, as long as it is a polymer having plurality of amide bonds (—NH—CO—) in a main molecular chain. Examples of (a-1) the polyamide resin include a product having an amide bond formed by a ring-opening polymerization of lactam or a reaction between a diamine component and a dicarboxylic acid component.

Examples of the lactam include ϵ-caprolactam, undecane caprolactam, lauryl caprolactam. Examples of the diamine include hexamethylenediamine, nonanediamine, methylpentadiamine, p-phenylenediamine, m-phenylenediamine, p-xylylenediamine, and m-xylylenediamine. Examples of the dicarboxylic acid include adipic acid, azelaic acid, sebacic acid, terephthaiic acid, and isophthalic acid.

Examples of (a-1) the polyamide resin are, an aliphatic polyamide such as polyamide 6, polyamide 11, polyamide 12, polyamide 66, polyamide 610, polyamide 6T, polyamide 6I, polyamide 9T, polyamide M5T, polyamide 612; an aromatic polyamide such as poly-p-phenyleneterephthalamide, poly-m-phenyleneisophthalamide; an amide copolymer such as a polyetherblock amide copolymer, a polyester amide copolymer, a polyether-ester amide copolymer, a polyamideimide copolymer. These polyamides may be used individually or in combination of at least two of them. Among them, the aliphatic polyamide such as polyamide 6, polyamide 66, polyamide 11, polyamide 12 is preferable.

Specific examples of (a-1) the polyamide resin include, "Rilsan (registered trademark) B (for example, Rilsan BESN TL, Rilsan BESN P20 YL, Rilsan BESN P40 TL, Rilsan MB3610, Rilsan BMF O, Rilsan BMN O, Rilsan BMN O TLD, Rilsan BMN BK TLD, Rilsan BMN P20 D, Rilsan BMN P40 D)" available from Arkema Inc.

(A) The polyamide resin composition preferably contains (a-2) a resin having at least one functional group selected from the group consisting of a hydroxyl group, a carboxyl group, an anhydride group, a sulfonic acid group, and an epoxy group (including a glycidyl group). Containing (a-2) component improves the impact resistance of (A) the polyamide resin composition, and thus the durability of the golf ball is improved.

(a-2) The resin having at least one functional group selected from the group consisting of a hydroxyl group, a carboxyl group, an anhydride group, a sulfonic acid group, and an epoxy group (including a glycidyl group) (hereinafter, sometimes merely referred to as "(a-2) functional group-containing resin") contained in (A) the polyamide resin composition will be explained.

(a-2) The functional group-containing resin is not limited, as long as it has at least one functional group selected from the group consisting of a hydroxyl group (—OH), a carboxyl group (—COOH), an anhydride group (—CO—O—CO—), a sulfonic acid group (—$SO_3H$), and an epoxy group (—COC—)(including a glycidyl group). It is noted that (a-2) the functional group-containing resin does not include an ethylene-(meth)acrylic acid binary copolymer, a metal-neutralized product of the binary copolymer, an ethylene-(meth)acrylic acid-(meth)acrylic acid ester ternary copolymer, a metal-neutralized product of the ternary copolymer used as (B), a nonionic thermoplastic resin having a melt viscosity (190° C.) ranging from 5 Pa·s to 1,000 Pa·s measured by a flow tester and an ionomer resin having a melt viscosity (190° C.) ranging from 1 Pa·s to 10 Pa·s measured by a brookfield viscometer used as (C) a fluidity improving agent, which are described later.

(a-2) The functional group-containing resin is preferably, for example, without limitation, a thermoplastic elastomer. Examples of the thermoplastic elastomer include a thermoplastic polyolefin elastomer, a thermoplastic polyester elastomer, a thermoplastic polyamide elastomer, a thermoplastic polyurethane elastomer, and a thermoplastic polystyrene elastomer. Among them, the thermoplastic polyolefin elastomer and the thermoplastic polystyrene elastomer are preferable, and the thermoplastic polystyrene elastomer is more preferable.

The thermoplastic polyolefin elastomer preferably contains ethylene as a component. Examples of the thermoplastic polyolefin having a functional group include an ethylene-glycidyl (meth)acrylate copolymer, an ethylene-(meth) acrylic acid ester-glycidyl (meth)acrylate copolymer, and an ethylene-glycidyl (meth)acrylate-vinyl acetate copolymer.

The polystyrene elastomer is preferably a hydrogenated product of a block copolymer consisting of a polystyrene block and a block mainly composed of a conjugated diene compound. Herein, a hydrogenated product of the block copolymer means that at least a part of unsaturated bonds derived from the conjugated diene compound in the block copolymer is hydrogenated. Examples of the polystyrene elastomer include a hydrogenated product (styrene-ethylene-butylene-styrene block polymer (SEBS)) of a block copolymer using 1,3-butadiene as the conjugated diene compound, and a hydrogenated product (styrene-ethylene/propylene-styrene (SEPS)) of a block copolymer using 2-methyl-1,3-butadiene as the conjugated diene compound.

Specific examples of (a-2) the resin having a functional group include thermoplastic polyolefin elastomers having a functional group such as "LOTARDER AX8840" manufactured by Arkema Inc., "ARUFON (registered trademark) UG-4030" manufactured by Toagosei Co., Ltd., and "Bond Fast (registered trademark) E" manufactured by Sumitomo Chemical Co., Ltd.; and thermoplastic polystyrene elastomers having a functional group such as "Tuftec (registered trademark) M1913 and Tuftec M1943" manufactured by Asahi Kasei Corporation, "FUSABOND (registered trademark) NM052D" manufactured by E.I. du Pont de Nemours and Company, "Dynaron (registered trademark) 4630P" manufactured by JSR Corporation.

Specific examples of (A) the polyamide resin composition include "NOVAMID (registered trademark) ST120" available from Mitsubishi Engineering-Plastics Company.

The flexural modulus of (A) the polyamide resin composition is 700 MPa or more, preferably 750 MPa or more, and more preferably 800 MPa or more, and is 4,000 MPa or less, preferably 3,500 MPa or less, and more preferably 3,000 MPa or less. If the flexural modulus of (A) the polyamide resin composition is 700 MPa or more, the intermediate layer has a sufficient resilience, and hence the effect of reducing the spin rate when hitting the driver shot is obtained. If the flexural modulus of (A) the polyamide resin composition is 4,000 MPa or less, the intermediate layer is not excessively hard, and thus the shot feeling and durability becomes good.

The melt flow rate (240° C., 2.16 kg) of (A) the polyamide resin composition is preferably 5.0 g/10 min or more, more preferably 6.0 g/10 min or more, and even more preferably 7.0 g/10 min or more, and is preferably 150 g/10 min or less, more preferably 140 g/10 min or less, and even more preferably 130 g/10 min or less. If the melt flow rate of (A) the polyamide resin composition falls within the above range, since the fluidity of the intermediate layer composition becomes good, it is possible to make a thin intermediate layer. Thus, the spin rate can be reduced upon a shot with a driver or the like, thereby obtaining a great flight distance.

The content of (A) the polyamide resin composition in the resin component contained in the high fluidity intermediate layer composition is preferably 20 mass % or more, more preferably 25 mass % or more, and even more preferably 30 mass % or more, and is preferably 90 mass % or less, more preferably 85 mass % or less, and even more preferably 80 mass % or less. If the content of (A) the polyamide resin composition in the resin component contained in the high fluidity intermediate layer composition is 20 mass % or more, the modulus of the intermediate layer becomes high. Thus, the effect of the high launch angle and low spin rate becomes larger. On the other hand, if the content of (A) the polyamide resin composition is 90 mass % or less, the modulus of the intermediate layer does not become excessively high. Thus, the resultant golf ball provides better shot feeling and durability.

Next, (B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer (hereinafter, sometimes merely referred to as "(B) copolymer and/or a metal-neutralized product thereof") will be explained.

The ethylene-(meth)acrylic acid binary copolymer (hereinafter, sometimes merely referred to as "binary copolymer") is a copolymer obtained by copolymerizing a monomer composition containing ethylene and (meth)acrylic acid. The ethylene-(meth)acrylic acid-(meth)acrylic acid ester ternary copolymer (hereinafter, sometimes merely referred to as "ternary copolymer") is a copolymer obtained by copolymerizing a monomer composition containing ethylene, (meth)acrylic acid, and (meth)acrylic acid ester. Examples of (meth)acrylic acid ester include methyl (meth) acrylate, ethyl (meth)acrylate, isopropyl (meth)acrylate, isobutyl (meth)acrylate, n-butyl (meth)acrylate, pentyl (meth)acrylate, hexyl (meth)acrylate, heptyl (meth)acrylate, isooctyl (meth)acrylate, and 2-ethylhexyl (meth)acrylate.

The content of the (meth)acrylic acid component in the binary copolymer or the ternary copolymer is preferably 2 mass % or more, more preferably 3 mass % or more, and is preferably 30 mass % or less, more preferably 25 mass % or less.

The binary copolymer or the copolymer may be obtained by copolymerizing another monomer to the extent that the effect of the present invention is not impaired. Examples of another monomer are a vinyl ester such as vinyl acetate, vinyl propionate; an unsaturated carboxylate such as dimethyl maleate, diethyl maleate; carbon monoxide, sulfur dioxide. In the case that another monomer is used, the content of another monomer in the binary copolymer or the ternary copolymer is preferably 40 mass % or less, more preferably 30 mass % or less, even more preferably 20 mass % or less.

The binary copolymer or the ternary copolymer used as (B) component preferably has melt viscosity (190° C.) more than 1,000 Pa·s measured by a flow tester.

Examples of the binary copolymer or the ternary copolymer include "NUCREL (registered trademark) (e.g. binary copolymer such as NUCREL NO903HC or the like) manufactured by Du Pont-Mitsui Polychemicals Co., Ltd.

The metal-neutralized product of the ethylene-(meth) acrylic acid binary copolymer (hereinafter, sometimes merely referred to as "metal-neutralized binary copolymer") is a metal-neutralized product obtained by neutralizing at least a part of carboxyl groups of the binary copolymer with a metal ion. The metal-neutralized product of the ethylene-(meth)acrylic acid-(meth)acrylic acid ester ternary copolymer (hereinafter, sometimes merely referred to as "metal-neutralized ternary copolymer") is a metal-neutralized product obtained by neutralizing at least a part of carboxyl groups of the ternary copolymer with a metal ion.

Examples of a metal (ion) used for the metal-neutralized binary or ternary copolymers include: monovalent metals (ions) such as sodium, potassium, lithium, and the like; divalent metals (ions) such as magnesium, calcium, zinc, barium, cadmium, and the like; trivalent metals (ions) such as aluminum and the like; and other metals (ions) such as tin, zirconium, and the like. Among these metals (ions), sodium, zinc and magnesium (ions) are preferably used because they provide excellent resilience, durability, or the like.

The degree of neutralization of the acidic groups contained in the metal-neutralized binary or ternary copolymers is preferably 20 mole % or more, more preferably 30 mole % or more, and is preferably 90 mole % or less, more preferably 85 mole % or less. The degree of neutralization of the acidic groups in the metal-neutralized binary or ternary copolymers can be calculated by using the following mathematical expression 1.

Degree of neutralization (mol %)=(the number of moles of acidic groups neutralized in a metal neutralized copolymer/the number of moles of all acidic groups contained in the metal neutralized copolymer)×100 [Mathematical Expression 1]

The metal-neutralized binary or ternary copolymer used as (B) component preferably has a melt viscosity (190° C.) in a range from 500 Pa·s to 100,000 Pa·s measured by a flow tester.

Specific examples of the metal-neutralized binary or ternary copolymers include trade name "Himilan (registered trademark) (e.g. the binary copolymerized ionomer such as Himilan 1555 (Na), Himilan 1557 (Zn), Himilan 1605 (Na), Himilan 1706 (Zn), Himilan 1707 (Na), Himilan AM7311 (Mg), Himilan AM7329(Zn); and the ternary copolymerized ionomer such as Himilan 1856 (Na), Himilan 1855 (Zn))" commercially available from Du Pont-Mitsui Polychemicals Co., Ltd.

Further, examples include "Surlyn (registered trademark) (e.g. the binary copolymerized ionomer such as Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and the ternary copolymerized ionomer such as Surlyn 6320 (Mg), Surlyn 8120 (Na), Surlyn 8320 (Na), Surlyn 9320 (Zn))" and the ternary copolymerized ionomer such as "HPF 1000 (Mg), HPF 2000 (Mg)" commercially available from E.I. du Pont de Nemours and Company.

Further, examples include "lotek (registered trademark) (e.g. the binary copolymerized ionomer such as lotek 8000 (Na), lotek 8030 (Na), lotek 7010 (Zn), lotek 7030 (Zn); and the ternary copolymerized ionomer such as lotek 7510 (Zn), lotek 7520 (Zn))" commercially available from ExxonMobil Chemical Corporation.

The metal-neutralized binary or ternary copolymers may be used alone or as a mixture of at least two of them. It is noted that Na, Zn, Li, and Mg described in the parentheses after the trade names indicate metal types of neutralizing metal ions for the metal-neutralized copolymer.

As (B) the copolymer and/or a metal-neutralized product thereof used in the present invention, preferred is the metal-neutralized product of the ethylene-(meth)acrylic acid binary copolymer and/or the metal-neutralized product of the ethylene-(meth)acrylic acid-(meth)acrylic acid ester ternary copolymer, which is neutralized with at least one metal ion selected from the group consisting of Li, Na, Ca, Zn, Mg and Cu.

The flexural modulus of (B) the copolymer and/or a metal-neutralized product thereof is 250 MPa or more, preferably 260 MPa or more, and more preferably 270 MPa or more, and is 1,000 MPa or less, preferably 800 MPa or less, and more preferably 600 MPa or less. If the flexural modulus of (B) the copolymer and/or a metal-neutralized product thereof is 250 MPa or more, the cover becomes sufficiently stiff, and the effect of reducing the spin rate is obtained. On the other hand, if the flexural modulus of (B) the copolymer and/or a metal-neutralized product thereof is 1,000 MPa or less, the stiffness of the cover does not become excessively high, and the durability and the shot feeling of the golf ball improves.

The content of (B) the copolymer and/or a metal-neutralized product thereof in the resin component constituting the high fluidity intermediate layer composition is preferably 10 mass % or more, more preferably 15 mass % or more, even more preferably 20 mass % or more, and is preferably 80 mass % or less, more preferably 75 mass % or less, and even more preferably 70 mass % or less. If the content of (B) the copolymer and/or a metal-neutralized product thereof is 10 mass % or more, the repulsion and the durability of the golf ball becomes better. On the other hand, if the content of (B) the copolymer and/or a metal-neutralized product thereof is 80 mass % or less, the elastic modulus of the intermediate layer can be made in an appropriate range, and hence the effects of increasing the launch angle and reducing the spin rate becomes larger.

Next, (C) the fluidity improving agent will be described.

(C) The fluidity improving agent is a component improving the fluidity of a mixture of (A) component and (B) component. In the present invention, (C) the fluidity improving agent is deemed not to be a resin component constituting the high fluidity intermediate layer composition.

(C) The fluidity improving agent preferably includes at least one selected from the group consisting of a fatty acid, a metal salt thereof, a nonionic thermoplastic resin having a melt viscosity (190° C.) ranging from 5 Pa·s to 1,000 Pa·s measured by a flow tester, and an ionomer resin having a melt viscosity (190° C.) ranging from 1 Pa·s to 10 Pa·s measured by a brookfield viscometer.

Examples of the fatty acid include, without limitation, saturated fatty acids such as butyric acid, valeric acid, hexanoic acid, heptanoic acid, octanoic acid, pelargonic acid, decanoic acid, lauric acid, myristic acid, palmitic acid, heptadecanoic acid, stearic acid, icosanoic acid, behenic acid, lignoceric acid, cerotic acid; and unsaturated fatty acids such as palmitoleic acid, oleic acid, linoleic acid, α-linolenic acid, γ-linolenic acid, and arachidonic acid.

The metal salts of the fatty acids include, without limitation, for example, metal salts of the fatty acids described above. Examples of the metal salts of the fatty acids include monovalent metal salts such as a sodium salt, a potassium salt, or a lithium salt of the fatty acids; divalent metal salts such as a magnesium salt, a calcium salt, a zinc salt, a barium salt, or a cadmium salt of the fatty acids; or a trivalent metal salts such as an aluminum salt of the fatty acids. Among them, divalent salts of the saturated fatty acids such as magnesium stearate, calcium stearate, zinc stearate, barium stearate, copper stearate are preferable.

The nonionic thermoplastic resin having a melt viscosity (190° C.) ranging from 5 Pa·s to 1,000 Pa·s measured by a flow tester, preferably includes a binary copolymer composed of ethylene and (meth)acrylic acid whose carboxyl groups are not neutralized, a ternary copolymer composed of ethylene, (meth)acrylic acid, and (meth)acrylic acid ester whose carboxyl groups are not neutralized, or a mixture thereof, which have a melt viscosity (190° C.) ranging from 5 Pa·s to 1,000 Pa·s measured by a flow tester.

Specific examples of the nonionic thermoplastic resin having a melt viscosity (190° C.) ranging from 5 Pa·s to 1,000 Pa·s measured by a flow tester are an ethylene-methacrylic acid Copolymer having a commercial name of "NUCREL (registered trademark) (e.g. NUCREL N1560, NUCREL N1050H, NUCREL N2050H, NUCREL AN4318, NUCREL N1110H, NUCREL NO 0200H) or an ethylene-acrylic acid copolymer having a commercial name of "PRIMACOR (registered trademark)" 59901" available from Du Pont-Mitsui Polychemicals Co., Ltd.

The ionomer resin having a melt viscosity (190° C.) ranging from 1 Pa·s to 10 Pa·s measured by a brookfield viscometer is not limited, and preferably includes, for example, a metal-neutralized product of the binary copolymer, and a metal-neutralized product of the ternary copolymer exemplified as (a-2) component, which has a melt viscosity (190° C.) ranging from 1 Pa·s to 10 Pa·s measured by a brookfield viscometer.

The ionomer resin having a melt viscosity (190° C.) ranging from 1 Pa·s to 10 Pa·s measured by a brookfield viscometer preferably includes a metal neutralized product of the binary copolymer composed of ethylene and (meth) acrylic acid and/or a metal neutralized product of the ternary copolymer composed of ethylene, (meth)acrylic acid, and (meth)acrylic acid ester, which is neutralized with at least one metal selected from the group consisting of Li, Na, Ca, Zn, Mg and Cu.

Specific examples of the ionomer resin having a melt viscosity (190° C.) ranging from 1 Pa·s to 10 Pa·s measured by a brookfield viscometer are "Aclyn (registered trade name) 201 (Ca)," "Aclyn246 (Mg)," and "Aclyn295 (Zn)" available from Honeywell Inc.

The fatty acid, a metal salt thereof, a nonionic thermoplastic resin having a melt viscosity (190° C.) ranging from 5 Pa·s to 1,000 Pa·s measured by a flow tester, and an ionomer resin having a melt viscosity (190° C.) ranging from 1 Pa·s to 10 Pa·s measured by a brookfield viscometer may be used alone or as a mixture of at least two of them. Among them, as (C) the fluidity improving agent in the present invention, the metal salt of the fatty acid or the binary copolymer composed of ethylene and (meth)acrylic acid having a melt viscosity (190° C.) ranging from 5 Pa·s to 1,000 Pa·s measured by a flow tester is preferable.

The content ratio ((A)/(B)) of (A) the polyamide resin composition to (B) the copolymer and/or a metal-neutralized product thereof (the total is 100 mass %) in the high fluidity intermediate layer composition is preferably 20 mass % to 80 mass %/80 mass % to 20 mass %, more preferably 25 mass % to 75 mass %/75 mass % to 25 mass %, and even more preferably 30 mass % to 70 mass %/70 mass % to 30 mass %. By causing the content ratio of (A) the polyamide resin composition to (B) the copolymer and/or a metal-neutralized product thereof to be in the above range, the intermediate layer has an appropriate stiffness, and the launch angle is increased and the spin rate is reduced, thereby improving the flight distance of the golf ball. In addition, the shot feeling is improved.

The content of (C) the fluidity improving agent in the high fluidity intermediate layer composition is preferably 1 part or more, more preferably 2 parts or more, even more preferably 3 parts or more, and is preferably 30 parts or less, more preferably 25 parts or less, even more preferably 20 parts or less with respect to 100 parts by mass of a sum of (A) the polyamide resin composition and (B) the copolymer and/or a metal-neutralized product thereof. If the content of (C) component is 1 part or more with respect to 100 parts by mass of a sum of (A) component and (B) component, the fluidity improving effect by (C) component becomes large, and thus the moldability of the cover is further improved. On the other hand, If the content of (C) component is 30 parts or less with respect to 100 parts by mass of a sum of (A) component and (B) component, the repulsion of the cover becomes good, and the distance of the golf ball is improved.

The high fluidity intermediate layer composition may contain another resin component in addition to (A) the polyamide resin composition, (B) the copolymer and/or a metal-neutralized product thereof and (C) the fluidity improving agent, as long as another resin component does not impair the effects of the present invention. However, it is preferred that the resin component in the high fluidity intermediate layer composition consists of (A) the polyamide resin composition, (B) the copolymer and/or a metal-neutralized product thereof, and (C) the fluidity improving agent.

The high fluidity intermediate layer composition may further contain pigment components such as a white pigment (titanium oxide), a blue pigment, and a red pigment; a specific gravity adjusting agent such as barium sulfate, tungsten and the like; a dispersant; an antioxidant; an ultraviolet absorber; a light stabilizer; a fluorescent material or a fluorescent brightener and the like, as long as they do not impair the effect of the present invention.

The amount of the white pigment (titanium oxide), with respect to 100 parts by mass of the resin component, is preferably 0.5 part by mass or more and more preferably 1 part by mass or more, and is preferably 10 parts by mass or less and more preferably 8 parts by mass or less. By causing the amount of the white pigment to be 0.5 parts by mass or more, it is possible to provide opacity to the intermediate layer. If the amount of the white pigment is more than 10 parts by mass, the durability of the resultant intermediate layer may deteriorate.

In the present invention, the melt flow rate (240° C., 2.16 kg) of the high fluidity intermediate layer composition is preferably 5.0 g/10 min or more, more preferably 7.0 g/10 min or more, and even more preferably 10.0 g/10 min or more, and is preferably 50.0 g/10 min or less, more preferably 45.0 g/10 min or less, and even more preferably 40.0 g/10 min or less. If the melt flow rate of the high fluidity intermediate layer composition is 5.0 g/10 min or more, the fluidity of the intermediate layer composition becomes good, and it is possible to make a thin intermediate layer. Thus, the spin rate when hitting a driver shot is reduced to give a great flight distance. If the melt flow rate is 50.0 g/10 min or less, the intermediate layer does not become excessively hard. Thus, the flight distance is improved while suppressing the lowering of the durability.

The high fluidity intermediate layer composition preferably has a slab hardness of 65 or more, more preferably 66 or more, even more preferably 67 or more, and preferably has a slab hardness of 75 or less, more preferably 73 or less, even more preferably 70 or less in Shore D hardness. If the slab hardness is 65 or more in Shore D hardness, the intermediate layer has a high hardness and the effect of the high launch angle and low spin rate becomes larger. If the slab hardness is 75 or less in Shore D hardness, the intermediate layer does not become excessively hard, and thus the durability of the golf ball becomes better.

The high fluidity intermediate layer composition preferably has the flexural modulus of 350 MPa or more, more preferably 370 MPa or more, even more preferably 400 MPa or more, and preferably has the flexural modulus of 1,000 MPa or less, more preferably 900 MPa or less, even more preferably 800 MPa or less. If the flexural modulus is 350 MPa or more, the effect of the high launch angle and low spin rate becomes larger. If the flexural modulus is 1,000 MPa or less, the high fluidity intermediate layer composition does not become excessively hard, the lowering of the moldablity is suppressed. Further, since the intermediate layer is not too hard, the durability of the golf ball becomes better.

The high fluidity intermediate layer composition preferably has the tensile modulus of 400 MPa or more, more preferably 410 MPa or more, even more preferably 420 MPa or more, and preferably has the tensile modulus of 2,000 MPa or less, more preferably 1,500 MPa or less, even more preferably 1,200 MPa or less. If the tensile modulus is 400 MPa or more, the effect of the high launch angle and low spin rate becomes larger. If the tensile modulus is 2,000 MPa or less, the intermediate layer does not become excessively hard, and thus the durability of the golf ball becomes better.

The melt flow rate, flexural modulus, slab hardness, and tensile modulus can be measured by the later described method. The melt flow rate, flexural modulus, slab hardness, and tensile modulus can be adjusted appropriately by controlling a combination of (A) the polyamide resin component, (B) the copolymer and/or a metal-neutralized product thereof, and (C) the fluidity improving agent, the content of the additive, or the like.

(2) Center Composition

As the center of the golf ball of the present invention, a conventionally known rubber composition (hereinafter sometimes simply referred to as "center rubber composition") may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4-bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.1 part by mass or more, more preferably 0.3 part by mass or more, even more preferably 0.5 part by mass or more and is preferably 3 parts by mass or less, more preferably 2.8 parts by mass or less, even more preferably 2.5 parts by mass or less based on 100 parts by mass of the base rubber. If the amount is less than 0.1 part by mass, the center becomes too soft, and the resilience tends to be lowered, and if the amount is more than 3 parts by mass, the amount of the co-crosslinking agent must be increased in order to obtain the appropriate hardness, and thus the repulsion is likely to be lowered.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and preferred because IL provides high resilience.

The amount of the co-crosslinking agent to be used is preferably 10 parts or more, more preferably 15 parts or more, even more preferably 20 parts or more, and is preferably 55 parts or less, more preferably 50 parts or less, even more preferably 48 parts or less based on 100 parts of the base rubber by mass. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 55 parts by mass, the center becomes too hard, so that the shot feeling may be lowered.

The filler contained in the center rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 0.5 parts or more, more preferably 1 part or more, and is preferably 30 parts or less, more preferably 20 parts or less based on 100 parts of the base rubber by mass. If the amount of the filler to be blended is less than 0.5 parts by mass, it becomes difficult to adjust the weight, while if it is more than 30 parts by mass, the weight ratio of the rubber component becomes small and the resilience tends to be lowered.

As the center rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis(4-chlorophenyl) disulfide, bis(3-chlorophenyl) disulfide, bis(4-bromophenyl) disulfide, bis(3-bromophenyl) disulfide, bis(4-fluorophenyl) disulfide, bis(4-iodophenyl) disulfide and bis(4-cyanophenyl) disulfide; a di-substituted diphenyl disulfide such as bis(2,5-dichlorophenyl) disulfide, bis(3,5-dichlorophenyl) disulfide, bis(2,6-dichlorophenyl) disulfide, bis(2,5-dibromophenyl) disulfide, bis (3,5-dibromophenyl) disulfide, bis(2-chloro-5-bromophenyl) disulfide, and bis(2-cyano-5-bromophenyl) disulfide; a tri-substituted diphenyl disulfide such as bis (2,4,6-trichlorophenyl) disulfide, and bis(2-cyano-4-chloro-6-bromophenyl) disulfide; a tetra-substituted diphenyl disulfide such as bis(2,3,5,6-tetra chlorophenyl) disulfide; a penta-substituted diphenyl disulfide such as bis (2,3,4,5,6-pentachlorophenyl) disulfide and bis (2,3,4,5,6-pentabromophenyl) disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

(3) Surrounding Layer Composition

Examples of the resin component of the surrounding layer composition for forming the surrounding layer include, in addition to the rubber composition like the center rubber composition, thermoplastic resins such as an ionomer resin having a trade name "Himilan (registered trademark) (e.g. "Himilan 1605" and "Himilan 1706") available from Du Pont-Mitsui Polychemicals Co., Ltd., an ionomer resin having a trade name "Surlyn (registered trademark) (e.g. "Surlyn 8140" and Surlyn "9120") available from E.I. du Pont de Nemours and Company, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A") available from BASF Japan Ltd, a thermoplastic polystyrene elastomer having a trade name "Rabalon (registered trademark)" commercially available from Mitsubishi Chemical Corporation, and the like. These thermoplastic resins and thermoplastic elastomers may be used solely or in combination of two or more types thereof. Among them, since the relatively low hardness and the high rebound property are required for the surrounding layer, the rubber composition like the center rubber composition is preferably used.

(4) Cover Composition

The following will describe the cover of the golf ball of the present invention. Examples of the resin component of the cover composition for forming the cover include, in addition to a polyurethane resin and a known ionomer resin, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polystyrene elastomer having a trade name "Rabalon (registered trademark)" commercially available from Mitsubishi Chemical Corporation, and the like. These resin components may be used solely or in combination of two or more types thereof. Among them, a polyurethane resin is preferable.

The cover composition for forming the cover of the golf ball of the present invention preferably contains a polyurethane resin as the resin component in an amount of 50 mass % or more, more preferably 60 mass % or more, and even more preferably 70 mass % or more. In a more preferable embodiment, the resin component in the cover composition consists of the polyurethane resin. If the resin component constituting the cover contains a thermosetting or thermoplastic polyurethane resin as a main component, the spin rate on the shots with the short iron is stabilized, and thus the controllability of the golf ball is improved.

The polyurethane resin is not particularly limited, as long as it has a plurality of urethane bonds within the molecule. For example, the polyurethane resin is a reaction product obtained by reacting a polyisocyanate component with a high-molecular-weight polyol component to have urethane bonds formed within the molecule. Further, a chain extension reaction with a low-molecular-weight polyol, a low-molecular-weight polyamine, or the like is performed if necessary.

The slab hardness in Shore D hardness of the polyurethane resin is preferably 10 or more, more preferably 20 or more, and even more preferably 25 or more, and is preferably 65 or less, more preferably 60 or less, and even more preferably 55 or less. If the hardness of the polyurethane resin is excessively low, the spin rate upon a shot with a driver may increase. Further, if the hardness of the polyurethane resin is excessively high, the spin rate upon a shot with an approach wedge may become excessively low. Specific examples of the polyurethane resin include Elastollan (registered trademark) XNY85A, XNY83A, XNY 90A, XNY75A, and ET880 manufactured by BASF Japan Ltd., and the like.

In the present invention, in addition to the aforementioned resin component, the cover may contain a pigment component such as a white pigment (titanium oxide), a blue pigment, a red pigment, and the like, a specific gravity adjusting agent such as zinc oxide, calcium carbonate, barium sulfate, and the like, a dispersant, an antioxidant, an ultraviolet absorber, a light stabilizer, a fluorescent material or a fluorescent brightener, and the like as long as they do not impair the performance of the cover.

The amount of the white pigment (titanium oxide), with respect to 100 parts by mass of the resin component for forming the cover, is preferably 0.5 parts by mass or more and more preferably 1 parts by mass or more, and is preferably 10 parts by mass or less and more preferably 8 parts by mass or less. By causing the amount of the white pigment to be 0.5 parts by mass or more, it is possible to provide opacity to the cover. If the amount of the white pigment is more than 10 parts by mass, the durability of the resultant cover may deteriorate.

(5) Golf Ball Construction

The golf ball of the present invention has no limitation on the construction, as long as it comprises a center, a cover and at least one intermediate layer disposed between the center and a cover.

FIG. 1 shows a preferable golf ball construction (hereinafter, sometimes may be referred to as "preferable construction A"). In a preferable golf ball construction A, the golf ball of the present invention comprises a core 34 having a center 31 and at least one intermediate layer 35 covering the center; and a cover 37 covering the core. The core 34 may further have a surrounding layer disposed between the center and the intermediate layer. Specific examples of the golf ball of the present invention include a three-piece golf ball comprising a core consisting of a center and an intermediate layer covering the center, and a cover covering the core; a four-piece golf ball comprising a core consisting of a center and two intermediate layers covering the center, and a cover covering the core; and a multi-piece golf ball comprising a core consisting of a center and multi-piece of intermediate layers or multi-layer of intermediate layers covering the center, and a cover covering the core. In a preferable construction A, the present invention is suitably applicable to a three-piece golf ball comprising a core consisting of a center and a single-layer intermediate layer covering the center, and a cover covering the core.

In a preferable construction A, a three-piece golf ball, which includes: a core consisting of a center and a single-layer intermediate layer covering the center; and a cover covering the core, wherein the intermediate layer is formed from the high fluidity intermediate layer composition, is more preferable.

In the present invention, the intermediate layer formed from the high fluidity intermediate layer composition is regarded as a part of the core, but it may be deemed as an inner cover layer. That is, the golf ball of the present invention includes a three-piece golf ball including a single-layered core and two cover layers covering the core, wherein an inner cover is formed from the high fluidity intermediate layer composition.

Figure 2:
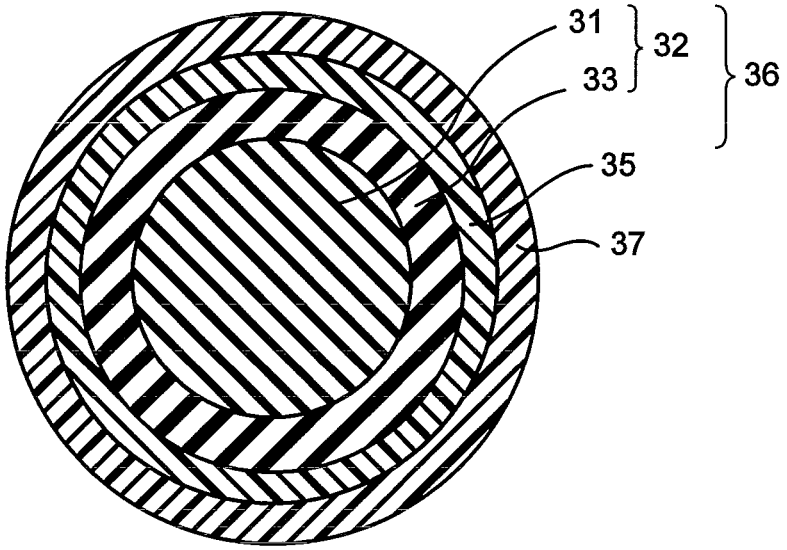
FIG. 2 is another preferable golf ball construction of the present invention.

FIG. 2 shows another preferable golf ball construction (hereinafter, sometimes may be referred to as "preferable construction B"). In another preferable golf ball construction B, the golf ball of the present invention comprises a inner core 32 consisting of a center 31 and a surrounding layer 33 covering the center;

at least one intermediate layer 35 covering the inner core; and a cover 37 covering the intermediate layer;

wherein at least one piece or one layer of the intermediate layer is formed from the highly fluidity intermediate layer composition described above and a surface hardness (H6) of the intermediate layer and a surface hardness (H4) of the inner core satisfy the equation: H6≥H4, and the cover has a slab hardness (H7) of 45 or less in Shore D hardness.

In a preferable construction B, the golf ball of the present invention comprises an inner core consisting of a center and a surrounding layer covering the center; at least one intermediate layer covering the inner core; and a cover covering the intermediate layer. Specific examples of the golf ball of the present invention include a four-piece golf ball comprising an inner core consisting of a center and a surrounding layer covering the center, an intermediate layer covering the inner core, and a cover covering the intermediate layer; and a multi-piece golf ball comprising an inner core consisting of a center and a surrounding layer covering the center, a multi-piece of or multi-layer of intermediate layers covering the inner core and a cover covering the intermediate layer. Among them, the present invention is suitably applicable to the four-piece golf ball comprising an inner core consisting of a center and a surrounding layer covering the center, an intermediate layer covering the core and a cover covering the intermediate layer.

It is noted that in the present invention, the spherical part consisting of a center 31 and a surrounding layer 33 covering the center exemplified in preferable construction B is defined as "inner core 32" in order to distinguish the core 34 having a center 31 and an intermediate layer 35 covering the center exemplified in preferable construction A. Further, the spherical part directly in contact with the outer most cover is defined as "outer core 36" in the present invention. Thus, the core 34 having a center 31 and an intermediate layer 35 covering the center exemplified in preferable construction A may be sometimes referred to as "an outer core 36" in the present invention. The outer core 36 having a center 31 and an intermediate layer 35 covering the center, may further include a surrounding layer 33 disposed between the center 31 and the intermediate layer 35 as shown in preferable construction B.

Next, the preferable golf ball construction A will be explained. In a preferable construction A, the golf ball of the present invention comprises:

a core having a center and at least one intermediate layer covering the center; and a cover covering the core, wherein at least one piece or one layer of the intermediate layer is formed from a high fluidity intermediate layer composition that contains (A) a polyamide resin composition having a flexural modulus in a range from 700 MPa to 4,000 MPa and a melt flow rate (240° C., 2.16 kg) of 5.0 g/10 min or more, and containing (a-1) a polyamide resin and (a-2) a resin having at least one functional group selected from the group consisting of a hydroxyl group, a carboxyl group, an anhydride group, a sulfonic acid group, and an epoxy group (including a glycidyl group);

(B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer; and (C) a fluidity improving agent.

The core in the preferable golf ball construction A includes, for example, a core consisting of a center and a single-layered intermediate layer covering the center, or a core consisting of a center and multi-piece or multi-layer of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs. For example, the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

When the center is covered with a single-layer intermediate layer or multi-layer of intermediate layers as the intermediate layer, at least one layer of the intermediate layer is formed from the high fluidity intermediate layer composition. When the depressed portions divided by the ribs provided on the surface of the center are preferably filled with a plurality of intermediate layers, at least one piece of the plurality of intermediate layers is formed from the high fluidity intermediate layer composition. It is noted that when the core consists a center and multi-piece of intermediate layers or multi-layer of intermediate layers covering the center, the core may include an intermediate layer which is formed from an intermediate layer composition different from the high fluidity intermediate layer composition, as long as it does not impair the effects of the present invention. In this case, it is preferred that the outermost layer of the core is an intermediate layer formed from the high fluidity intermediate layer composition, and it is preferred that all the multi-piece of intermediate layers or multi-layer of intermediate layers are formed from the high fluidity intermediate layer composition.

Examples of the intermediate layer composition which is different from the high fluidity intermediate layer composition include, in addition to a later-described rubber composition for the center and the ionomer resin, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A")" commercially available from BASF Japan Ltd., a thermoplastic polystyrene elastomer having a trade name "Rabalon (registered trademark)" commercially available from Mitsubishi Chemical Corporation, and the like. In addition, the intermediate layer composition may contain a specific gravity adjusting agent such as barium sulfate, tungsten, and the like, an antioxidant, a pigment, and the like.

The thickness of the intermediate layer formed from the high fluidity intermediate layer composition is preferably 0.5 mm or more, more preferably 0.6 mm or more, and even more preferably 0.7 mm or more, and is preferably 2.0 mm or less, more preferably 1.8 mm or less, and even more preferably 1.5 mm or less. If the thickness of the intermediate layer formed from the high fluidity intermediate layer composition is 0.5 mm or more, since the intermediate layer does not become excessively thin, the durability of the golf ball becomes better. If the thickness of the intermediate layer is 2.0 mm or less, the repulsion of the golf ball becomes better to give a greater flight distance. Further, the shot feeling becomes better.

The diameter of the center is preferably 25 mm or more and more preferably 30 mm or more, and is preferably 41 mm or less and more preferably 40 mm or less. If the diameter of the center is less than 25 mm, the thickness of the intermediate layer or the cover needs to be greater than a desired thickness, and hence the resilience may deteriorate. On the other hand, if the diameter of the center exceeds 41 mm, the thickness of the intermediate layer or the cover needs to be smaller than the desired thickness, and hence the intermediate layer or the cover may not function well.

When the center has a diameter in a range from 25 mm to 41 mm, a compression deformation amount of the center (an compression amount of the center in the compression direction thereof) when applying a load from an initial load of 98 N to a final load of 1275 N is preferably 1.5 mm or more and more preferably 2.0 mm or more, and is preferably 5.0 mm or less and more preferably 4.0 mm or less. If the compression deformation amount is less than 1.5 mm, the shot feeling may become hard and deteriorate. If the compression deformation amount exceeds 5.0 mm, the repulsion may deteriorate.

The surface hardness H2 in Shore D hardness of the center is preferably 40 or more, more preferably 48 or more, and even more preferably 54 or more, and is preferably 75 or less, more preferably 67 or less, and even more preferably 64 or less. If the surface hardness H2 in Shore D hardness of the center is less than 40, the golf ball becomes excessively soft and the repulsion may deteriorate, thereby decreasing the flight distance. On the other hand, if the surface hardness H2 in Shore D hardness of the center is more than 75, the golf ball becomes excessively hard and the shot feeling may deteriorate.

The diameter of the core of the golf ball in a preferable construction A is preferably 30 mm or more, more preferably 35 mm or more, and even more preferably 37 mm or more. If the diameter of the core is less than 30 mm, the cover becomes excessively thick and thus the repulsion may deteriorate. Further, the diameter of the core is preferably 42.2 mm or less, more preferably 42.0 mm or less, and even more preferably 41.8 mm or less. If the diameter of the core is more than 42.2 mm, the cover becomes relatively thin and a protection effect of the cover is not sufficiently obtained.

When the core has a diameter in a range from 30 mm to 42.2 mm, a compression deformation amount of the core (an compression amount of the core in the compression direction thereof) when applying a load from an initial load of 98 N to a final load of 1275 N is preferably 1.5 mm or more and more preferably 2.0 mm or more, and is preferably 5.0 mm or less and more preferably 4.0 mm or less. If the compression deformation amount is less than 1.5 mm, the shot feeling may become hard and deteriorate. If the compression deformation amount exceeds 5.0 mm, the resilience may deteriorate.

It is preferable that the core of the present invention has a larger surface hardness H6 than the center hardness H1. The hardness difference (H6–H1) between the surface hardness H6 and the center hardness H1 of the core in the preferable construction A is preferably 10 or larger, more preferably 15 or larger in Shore D hardness. Making the surface hardness of the core larger than the center hardness increases the launch angle and reduces the spin rate, thereby improving the flight distance. The hardness difference (H6–H1) between the surface hardness H6 and the center hardness H1 of the core is, without limitation, preferably 55 or less, more preferably 50 or less in Shore D. If the hardness difference is too large, the durability of the golf ball tends to be lower.

The center hardness H1 of the core is preferably 20 or larger, more preferably 27 or larger, and even more preferably 32 or larger in Shore D hardness. If the center hardness H1 is 20 or larger in Shore D hardness, the core does not become too soft, resulting in the good repulsion. The center hardness H1 of the core is preferably 60 or smaller, more preferably 53 or smaller, and even more preferably 48 or smaller in Shore D. If the center hardness H1 is 60 or less in Shore D hardness, the core does not become too hard, resulting in the good shot feeling. In the present invention, the center hardness H1 of the core is the hardness measured with the Shore D type spring hardness tester at the central point of a cut plane of a core which has been cut into two halves.

The surface hardness H6 of the core is preferably 40 or larger, more preferably 48 or larger, and even more preferably 54 or larger in Shore D hardness. If the surface hardness H6 is 40 or larger, the core does not become too soft, and the good repulsion would be obtained. The surface hardness H6 of the core is preferably 75 or smaller, more preferably 72 or smaller, and even more preferably 70 or smaller in shore D hardness. If the surface hardness H6 is 75 or less in Shore D hardness, the core does not become too hard, and the good shot feeling would be obtained.

The slab hardness H7 in Shore D hardness of the cover composition is preferably 60 or less, more preferably 53 or less, and even more preferably 48 or less. By causing the slab hardness H7 of the cover composition to be 60 or less, the spin rate upon an approach shot with a short iron is enhanced. As a result, a golf ball with excellent controllability upon an approach shot is obtained. In order to ensure a sufficient spin rate upon an approach shot, the slab hardness H7 in Shore D hardness of the cover composition is preferably 20 or more, more preferably 23 or more, and even more preferably 25 or more.

In the preferable golf ball construction A, the thickness of the cover of the golf ball is preferably 3 mm or less, more preferably 2.5 mm or less, and even more preferably 2 mm or less. If the thickness of the cover is 3 mm or less, the repulsion and shot feeling become better. The thickness of the cover is preferably 0.1 mm or more, more preferably 0.2 mm or more, and even more preferably 0.3 mm or more. If the thickness of the cover is less than 0.1 mm, it becomes difficult to mold the cover. In addition, the durability and the abrasion resistance of the cover may deteriorate.

When the golf ball in the preferable golf ball construction A has a diameter in a range from 40 mm to 45 mm, a compression deformation amount of the golf ball (an amount of compression of the golf ball in the compression direction thereof) when applying a load from an initial load of 98 N to a final load of 1275 N to the golf ball is preferably 2.0 mm or more, more preferably 2.1 mm or more, and even more preferably 2.2 mm or more, and is preferably 3.0 mm or less, more preferably 2.9 mm or less, and even more preferably 2.8 mm or less. By causing the compression deformation amount to be 2.0 mm or more, desirable shot feeling is obtained. By causing the compression deformation amount to be 3.0 mm or less, desirable repulsion is obtained.

Next, the preferable golf ball construction B will be explained. In a preferable construction B, the golf ball of the present invention comprises: an inner core consisting of a center and a surrounding layer covering the center, at least one intermediate layer covering the inner core, and a cover covering the intermediate layer, wherein at least one piece or one layer of the intermediate layer is formed from a high fluidity intermediate layer composition that has a melt flow rate (240° C., 2.16 kg) of 5.0 g/10 min or more and contains;

(A) a polyamide resin composition having a flexural modulus in a range from 700 MPa to 4,000 MPa;

(B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer; and (C) a fluidity improving agent, wherein a surface hardness (H6) of the intermediate layer and a surface hardness (H4) of the inner core satisfy the equation: H6≥H4, and the cover has a slab hardness (H7) of 45 or less in Shore D hardness.

The inner core used in the preferable construction B is a two-layered core consisting of a center and a surrounding layer covering the center.

Next, the surrounding layer constituting the two-layered core will be explained.

The slab hardness H3 of the surrounding layer is preferably 40 or more, more preferably 42 or more, and even more preferably 43 or more, and is preferably 65 or less, more preferably 63 or less, and even more preferably 57 or less in Shore D hardness. If the slab hardness H3 of the surrounding layer is 40 or more in Shore D hardness, the repulsion performance of the resultant golf ball becomes better. On the other hand, if the slab hardness H3 of the surrounding layer is 65 or less in Shore D hardness, the shot feeling of the obtained golf ball becomes better. Herein, the slab hardness of the surrounding layer composition can be adjusted by appropriately selecting the combinations of the resin components and the rubber compositions described above.

In the case that the surrounding layer is formed from the surrounding layer composition comprising the rubber composition as a main component (50 mass % or more), the center preferably has a diameter of 5.0 mm or more, more preferably 10.0 mm or more and preferably has a diameter of 35.0 mm or less, more preferably 30.0 mm or less. If the center has a diameter of 5.0 mm or more, the relatively soft center functions better, especially the spin rate on the W#1 driver shots is decreased. On the other hand, if the center has a diameter of 35.0 mm or less, the thickness of the surrounding layer, intermediate layer and the cover layer does not become excessively thin, and each layer functions well.

When the center has a diameter from 5.0 mm to 35.0 mm, the center preferably has a compression deformation amount (an compression amount of the center in the compression direction thereof) of 4.0 mm or more, more preferably 4.5 mm or more, and preferably has a compression deformation amount of 10.0 mm or less, more preferably 8.0 mm or less, when applying a load from an initial load of 98 N to a final load of 1275 N. If the compression deformation amount is 4.0 mm or more, the shot feeling becomes better, while if the compression deformation amount is 10.0 mm or less, the repulsion becomes better.

In the case that the surrounding layer is formed from the surrounding layer composition comprising the resin composition as a main component (50 mass % or more), the center preferably has a diameter of 31.0 mm or more, more preferably 35.0 mm or more and preferably has a diameter of 41.0 mm or less, more preferably 40.0 mm or less. If the center has a diameter of 31.0 mm or more, the intermediate layer and the cover layer can be made thinner, thus the repulsion of the golf ball is further improved. On the other hand, if the center has a diameter of 41.0 mm or less, the thickness of the intermediate layer and the cover layer does not become excessively thin, and thus the intermediate layer and the cover layer functions well.

When the center has a diameter from 31.0 mm to 41.0 mm, the center preferably has a compression deformation amount (an compression amount of the center in the compression direction thereof) of 2.0 mm or more, more preferably 2.5 mm or more, and preferably has a compression deformation amount of 5.0 mm or less, more preferably 4.0 mm or less, when applying a load from an initial load of 98 N to a final load of 1275 N. If the compression deformation amount is 2.0 mm or more, the shot feeling becomes better, while if the compression deformation amount is 5.0 mm or less, the repulsion becomes better.

In the case of using the surrounding layer composition containing the rubber composition as a main component (50 mass % or more), the surrounding layer preferably has a thickness of 3.0 mm or more, more preferably 5.0 mm or more, even more preferably 7.0 mm or more, and preferably has a thickness of 17.0 mm or less, more preferably 15.0 mm or less, even more preferably 13.0 mm or less. In the case of using the surrounding layer composition containing the resin composition as a main component (50 mass % or more), the surrounding layer preferably has a thickness of 0.2 mm or more, more preferably 0.4 mm or more, even more preferably 0.6 mm or more, and preferably has a thickness of 3.0 min or less, more preferably 2.5 mm or less, even more preferably 2.0 mm or less. If the thickness of the surrounding layer is not less than the lower limit of the above range, the effect of the surrounding layer becomes large and thus the effect of suppressing the spin rate on the driver shot becomes larger. If the thickness is not more than the upper limit of the above range, the effect of the core becomes large and thus the repulsion becomes better.

The diameter of the inner core in the preferable construction B is preferably 32.0 mm or more, more preferably 34.0 mm or more, and even more preferably 39.0 mm or more, and is preferably 41.5 mm or less, more preferably 41.0 mm or less, and even more preferably 40.5 mm or less. If the diameter of the inner core falls within the above range, the effect of suppressing the spin rate on the driver shots is further improved.

When the inner core has a diameter from 32.0 mm to 41.5 mm, the core preferably has a compression deformation amount (an compression amount of the core in the compression direction thereof) of 2.0 mm or more, more preferably 2.2 mm or more, even more preferably 2.3 mm or more, and preferably has a compression deformation amount of 4.5 mm or less, more preferably 4.0 mm or less, even more preferably 3.5 mm or less, when applying a load from an initial load of 98 N to a final load of 1275 N. If the compression deformation amount is 2.0 mm or more, the effect of suppressing the spin rate on the driver shot and the shot feeling are further improved. On the other hand, if the compression deformation amount is 4.5 mm or less, the repulsion becomes better.

It is preferable that the inner core in the preferable construction B has a larger surface hardness H4 than the center hardness H1. The hardness difference (H4−H1) between the surface hardness H4 and the center hardness H1 of the inner core in the preferable construction B is preferably 10 or larger, more preferably 15 or larger, even more preferably 20 or more in Shore D hardness. Making the surface hardness of the inner core larger than the center hardness increases the launch angle and decreases the spin rate, thereby improving the flight distance of the golf ball. The hardness difference (H4−H1) between the surface hardness H4 and the center hardness H1 of the inner core is, without limitation, preferably 55 or less, more preferably 50 or less, even more preferably 40 or less in Shore D. If the hardness difference is too large, the durability of the golf ball tends to be low.

The center hardness H1 of the inner core is preferably 20 or larger, more preferably 27 or larger, and even more preferably 32 or larger in Shore D hardness. If the center hardness H1 is 20 or larger in Shore D hardness, the inner core does not become too soft, resulting in the good repulsion. The center hardness H1 of the inner core is preferably 60 or smaller, more preferably 53 or smaller, and even more preferably 48 or smaller in Shore D. If the center hardness H1 is 60 or less in Shore D hardness, the inner core does not become too hard, resulting in the good shot feeling. In the present invention, the center hardness H1 of the core is the hardness measured with the Shore D type spring hardness tester at the central point of a cut plane of a core which has been cut into two halves.

The surface hardness H4 of the inner core is preferably 45 or larger, more preferably 47 or larger, and even more preferably 48 or larger in Shore D hardness. If the surface hardness H4 is 45 or larger in Shore D hardness, the inner core does not become too soft, and the good resilience would be obtained. The surface hardness H4 of the inner core is preferably 65 or smaller, more preferably 63 or smaller, and even more preferably 60 or smaller in shore D hardness. If the surface hardness H4 is 65 or smaller in Shore D hardness, the hardness difference from the intermediate layer can be made large, thus the effect of lowering the spin rate on the driver shots becomes larger.

Next, the intermediate layer covering the inner core will be explained.

In the preferable golf ball construction B, at least one piece or one layer of the intermediate layer is formed from the high fluidity intermediate layer composition described above and a surface hardness (H6) of the intermediate layer and a surface hardness (H4) of the inner core satisfy the equation: $H6 \geq H4$.

The thickness of the intermediate layer formed from the high fluidity intermediate layer composition is preferably 0.2 mm or more, more preferably 0.3 mm or more, and even more preferably 0.4 mm or more, and is preferably 2.0 mm or less, more preferably 1.5 mm or less, and even more preferably 1.0 mm or less. By causing the thickness of the intermediate layer formed from the high fluidity intermediate layer composition to be 0.2 mm or more, the effect of the intermediate layer becomes large and thus the effect of suppressing the spin rate on the driver shots is further improved. In addition, by causing the thickness of the intermediate layer to be 2.0 mm or less, the lowering of the shot feeling can be suppressed.

The surface hardness H6 of the intermediate layer formed from the high fluidity intermediate layer composition is preferably 65 or more, more preferably 67 or more, even more preferably 69 or more, and is preferably 80 or less, more preferably 78 or less, even more preferably 75 or less in Shore D hardness. If the surface hardness H6 is 65 or more in Shore D hardness, the hardness and stiffness of the intermediate layer is high, and thus the effect of suppressing the spin rate on the driver shots is further improved. If the surface hardness H6 of the intermediate layer is 80 or less in Shore D hardness, the hardness of the intermediate layer does not become excessively high, and thus the durability and the shot feeling of the golf ball are further improved.

The hardness difference between the surface hardness (H6) of the intermediate layer and the surface hardness (H4) of the inner core is preferably 3 or more, more preferably 4 or more, even more preferably 5 or more, and is preferably 25 or less, more preferably 18 or less, even more preferably 16 or less in Shore D hardness. If the surface hardness difference (H6−H4) falls within the above range, the spin rate becomes lower and the distance is improved.

Embodiments of the inner core and the intermediate layer include an embodiment where the inner core is covered with a single-layered intermediate layer, and an embodiment where the inner core is covered with multi-piece or multi-layered of intermediate layers.

The shape of the outer core consisting of the inner core and the intermediate layer covering the inner core preferably has a spherical shape. If the outer core does not have a spherical shape, the cover does not have a uniform thickness. As a result, there exist some portions where the performance of the cover is lowered. On the other hand, the inner core generally has the spherical shape, but the inner core may be provided with a rib on the surface thereof so that the surface of the spherical inner core is divided by the ribs. For example, the surface of the spherical inner core is preferably evenly divided by the ribs. In one embodiment, the ribs are preferably formed on the surface of the surrounding layer in an integrated manner, and in another embodiment, the ribs are formed as a surrounding layer on the surface of the spherical center.

The ribs are preferably formed along an equatorial line and meridians that evenly divide the surface of the spherical inner core, if the spherical inner core is assumed as the earth. For example, if the surface of the spherical inner core is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to obtain the spherical shape. The shape of the ribs, without limitation, includes an arc or an almost arc (for example, a part of the arc is removed to obtain a flat surface at the cross or orthogonal portions thereof).

When the inner core is covered with a single-layer intermediate layer or multi-layer of intermediate layers as the intermediate layer, at least one layer of the intermediate layer is formed from the high fluidity intermediate layer composition. When the depressed portion divided by the ribs provided on the surface of the inner core are filled with a plurality of intermediate layers, at least one piece of the plurality of intermediate layers is formed from the high fluidity intermediate layer composition. It is noted that when the inner core is covered with multi-piece of or multi-layer of intermediate layers, another intermediate layer which is formed from another intermediate layer composition different from the high fluidity intermediate layer composition may be used, as long as it does not impair the effects of the present invention. In this case, it is preferred that the intermediate layer in contact with the cover is the intermediate layer formed from the high fluidity intermediate layer composition. It is much preferred that all the multi-piece of intermediate layers or multi-layer of intermediate layers are formed from the high fluidity intermediate layer composition.

As the intermediate layer composition other than the high fluidity intermediate layer composition, the same materials described as the surrounding layer composition can be exemplified. The specific gravity adjusting agent such as barium sulfate and tungsten, an anti-oxidant, and a pigment may be blended into the intermediate layer composition.

In the preferable golf ball construction B, the slab hardness H7 of the cover is preferably 45 or less, more preferably 40 or less, and even more preferably 38 or less in Shore D hardness. If the slab hardness H7 of the cover is 45 or less in Shore D hardness, the spin performance on the approach shots with a short iron or the like is enhanced. As a result, a golf ball with excellent controllability on approach shots is obtained. The slab hardness H7 of the cover is preferably 10 or more, more preferably 15 or more in Shore D hardness. If the slab hardness H7 of the cover is less than 10 in Shore D hardness, the spin rate on the approach shots with a short iron or the like may become too high. Herein, the slab hardness H7 of the cover is a measured hardness of the cover composition that is molded into a sheet form by a measuring method described later.

In the preferable golf ball construction B, the thickness of the cover of the golf ball is preferably 0.8 mm or less, more preferably 0.6 mm or less, even more preferably 0.5 mm or less, even more preferably 0.4 mm or less. If the cover has a thickness of 0.8 mm or less, the effect of suppressing the spin rate on the driver shot and the shot feeling are further improved. The thickness of the cover is preferably 0.1 mm or more, more preferably 0.15 mm or more. If the thickness is 0.1 mm or more, the spin performance on the approach shots become better. Herein, the thickness is measured at the portion where the dimples are not formed, that is the thickness under the land 12 (refer to FIG. 3), and the thicknesses measured at least 4 portions are averaged.

When the golf ball of the present invention has a diameter in a range from 40 mm to 45 mm, a compression deformation amount of the golf ball (deformation amount of the golf ball in the compression direction thereof) when applying a load from an initial load of 98 N to a final load of 1275 N to the golf ball is preferably 2.0 mm or more, more preferably 2.1 mm or more, and even more preferably 2.2 mm or more, and is preferably 3.0 mm or less, more preferably 2.9 mm or less, and even more preferably 2.8 mm or less. By causing the compression deformation amount to be 2.0 mm or more, desirable shot feeling is obtained. By causing the compression deformation amount to be 3.0 mm or less, desirable resilience is obtained.

(6) Method for Producing the Golf Ball

Next, the method for producing the golf ball of the present invention will be explained.

The present invention also provides a method for producing a golf ball having a core having a center and at least one intermediate layer covering the center and a cover covering the core, comprising, dry blending (A) a polyamide resin composition having a flexural modulus in a range from 700 MPa to 4,000 MPa and a melt flow rate (240° C., 2.16 kg) of 5.0 g/10 min or more, and containing (a-1) a polyimide resin and (a-2) a resin having at least one functional group selected from the group consisting of a hydroxyl group, a carboxyl group, an anhydride group, a sulfonic acid group, and an epoxy group (including a glycidyl group) with (B) at least one member selected from the group consisting of an ethylene-(meth) acrylic acid binary copolymer, a metal-neutralized product of the binary copolymer, an ethylene-(meth)acrylic acid-(meth)acrylic acid ester ternary copolymer, and a metal-neutralized product of the ternary copolymer;

mixing a melt of (C) a fluidity improving agent to an obtained mixture of (A) component and (B) component, while adding (C) the fluidity improving agent in a liquid state to prepare a high fluidity intermediate layer composition by extrusion, forming an intermediate layer from the obtained high fluidity intermediate layer composition; and forming a cover from a cover composition on the intermediate layer.

(C) component generally has a low melting temperature and high bulk specific gravity. In order to mix (A) to (C) components homogeneously, it is preferable to mix (A) component and (B) component and subsequently add a melt of (C) component in a liquid state to the mixture of (A) component and (B) component.

In a step for dry blending (A) component and (B) component, a method for dry blending is not limited, and it is preferable to use a mixer capable of blending pellet materials, and it is more preferable to use a tumbler mixer.

Embodiments for dry blending (A) component and (B) component includes an embodiment in which (a-1) component and (a-2) component are mixed and extruded to prepare (A) component in a pellet form, and (A) component and (B) component each in a pellet form are dry blended; and an embodiment in which (a-1) component, (a-2) component, and (B) component each in a pellet form are dry blended.

In a step for mixing a melt of (C) a fluidity improving agent to a mixture of (A) component and (B) component, while adding (C) the fluidity improving agent in a liquid state to prepare a high fluidity intermediate layer composition by extrusion, a method for producing the high fluidity intermediate layer composition includes, for example, with an extruder provided with a side feeder, mixing (A) component and (B) component which are fed through the main feeder prior to mixing (C) component which is fed from the side feeder. In this case, the temperature to melt (C) component is preferably from +10° C. to +30° C. with respect to the melting point of (C) component. Further, the mixing temperature preferably ranges from 100° C. to 250° C.

An embodiment for molding an intermediate layer is not particularly limited, and includes an embodiment which comprises injection molding the high fluidity intermediate layer composition directly onto the center, or an embodiment which comprises molding the high fluidity intermediate layer composition into a hollow-shell, covering the center with a plurality of the hollow-shells and subjecting the center with a plurality of the hollow shells to the compression-molding (preferably an embodiment which comprises molding the high fluidity intermediate layer composition into a half hollow-shell, covering the center with the two half hollow-shells, and subjecting the center with the two half hollow-shells to the compression-molding).

In the case of directly injection molding the high fluidity intermediate layer composition onto the center, it is preferred to use upper and lower molds for forming the intermediate layer having a spherical cavity and pimples, wherein a part of the pimple also serves as a retractable hold pin. When forming the intermediate layer by injection molding, the hold pin is protruded to hold the center, and the high fluidity intermediate layer composition which has been heated and melted is charged and then cooled to obtain a cover. For example, the high fluidity intermediate layer composition heated and melted at the temperature of 150° C. to 230° C. is charged into a mold held under the pressure of 980 KPa to 1,500 KPa for 0.1 to 1 second. After cooling for 15 to 60 seconds, the mold is opened.

When molding the intermediate layer in a compression molding method, molding of the half shell can be performed by either compression molding method or injection molding method, and the compression molding method is preferred. The compression-molding of the high fluidity intermediate layer composition into half shell can be carried out, for example, under a pressure of 1 MPa or more and 20 MPa or less at a temperature of −20° C. or more and 70° C. or less relative to the flow beginning temperature of the high fluidity intermediate layer composition. By performing the molding under the above conditions, a half shell having a uniform thickness can be formed. Examples of a method for molding the intermediate layer using half shells include compression molding by covering the center with two half shells. The compression molding of half shells into the intermediate layer can be carried out, for example, under a pressure of 0.5 MPa or more and 25 MPa or less at a temperature of −20° C. or more and 70° C. or less relative to the flow beginning temperature of the high fluidity intermediate layer composition. By performing the molding under the above conditions, the intermediate layer having a uniform thickness can be formed.

The molding temperature means the highest temperature where the temperature at the surface of the concave portion of the lower mold reaches from closing through opening the molds. Further, the flow beginning temperature of the cover material can be measured in a pellet form with the following conditions by using a flow characteristics evaluation apparatus (Flow Tester CFT-500D, manufactured by Shimadzu Corporation).

Measuring conditions: Area size of a plunger: 1 $cm^2$, Die length: 1 mm, Die diameter: 1 mm, Load: 588.399 N, Start temperature: 30° C., and Temperature increase rate: 3° C./min.

The center can be obtained by mixing, kneading the above mentioned rubber composition and molding the rubber composition in the mold. The conditions for press-molding the center rubber composition should be determined depending on the rubber composition. Specifically, the press-molding is preferably carried out for 10 to 60 minutes at the temperature of 130° C. to 200° C. Alternatively, the press-molding is preferably carried out in a two-step heating, for example, for 20 to 40 minutes at the temperature of 130° C. to 150° C., and continuously for 5 to 15 minutes at the temperature of 160° C. to 180° C.

The surrounding layer is formed by, for example, covering the center with the surrounding layer composition. Examples of the method for forming the surrounding layer includes, without any limitation, a method which comprises molding the surrounding layer composition into a hemispherical hollow-shell, covering the center with two half hollow-shells and subjecting the center to the press-molding under the condition of 130° C. to 170° C. for 1 to 5 minutes or a method which comprises directly injection-molding the surrounding layer composition onto the center, thereby covering the center with the surrounding layer composition.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the case of directly injection molding the cover composition onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

When molding the cover in a compression molding method, molding of the half shell can be performed by either compression molding method or injection molding method, and the compression molding method is preferred. The compression-molding of the cover composition into half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

Figure 3:
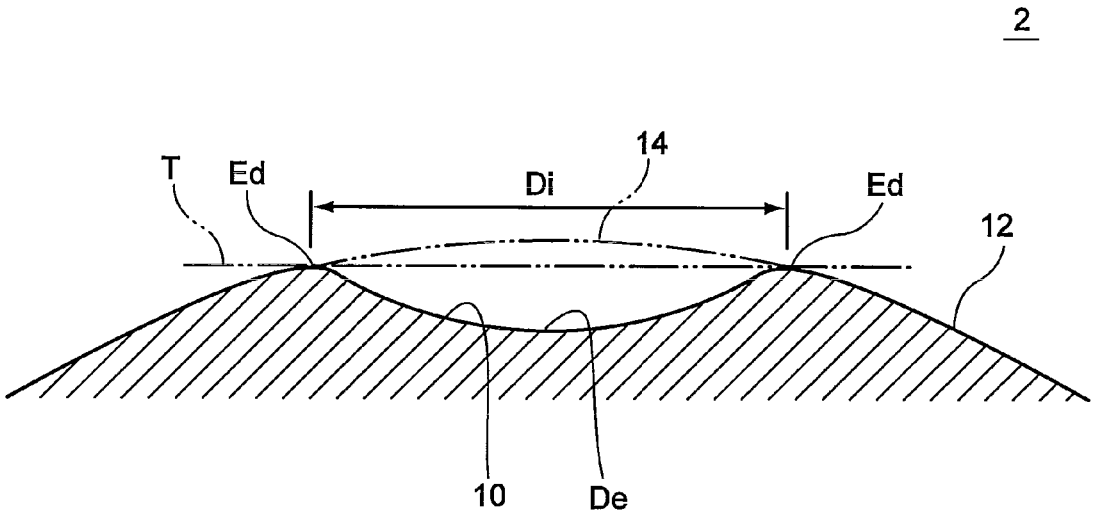
FIG. 3 is an expanded sectional view of the dimples formed on the surface of the golf ball body.

When molding a cover, the concave portions called "dimple" are usually formed on the surface. FIG. 3 is an expanded sectional view of a part of a golf ball 2. This figure shows a cross-section which includes the deepest part De of a dimple 10 and the center of the golf ball 2. The up and down direction in FIG. 3 is the depth direction of the dimple 10. The depth direction is the direction from the gravity center of the area of the dimple 10 to the center of the golf ball 2. A chain double-dashed line 14 in FIG. 3 shows a virtual sphere. The surface of the virtual sphere 14 is the surface of the golf ball 2 in the case of assuming that there is no dimple 10. The dimple 10 is depressed in the virtual sphere 14. A land 12 corresponds to the virtual sphere 14.

Two headed arrow Di in FIG. 3 shows the diameter of the dimple 10. The diameter Di is the distance from one contact point Ed to another contact point Ed when a common tangent line T is drawn in both sides of the dimple 10. The contact points Ed are edges of the dimple 10. The edges Ed define the outline of the dimple 10. The diameter Di is preferably 2.0 mm or more and 6.0 mm or less. If the diameter Di is less than the above range, the dimple effect is hardly obtained and if the diameter Di exceeds 6.0 mm, the intrinsic property of the golf ball 2, that is, it is substantially spherical, is lost. The volume of the dimple means the volume of the portion surrounded by the curved plane including the outline of the dimple 10 and the virtual sphere 14. The total volume of the dimples 10 is preferably 250 $mm^3$ or more and 400 $mm^3$ or less. If the total volume is less than 250 $mm^3$, a hopping trajectory may be provided in some cases. If the total volume exceeds 400 $mm^3$, a dropping trajectory may possibly be provided.

In FIG. 3, the distance between the tangent line T and the deepest point De is the depth of the dimple 10. The depth is preferably 0.05 mm or more and 0.60 mm or less. If the depth is less than 0.05 mm, a hopping trajectory may be provided in some cases. On the other hand, if the depth exceeds 0.60 mm, a dropping trajectory may possibly be provided.

The total number of the dimples 10 formed on the cover is preferably 200 or more and 500 or less. If the total number is less than 200, the dimple effect is hardly obtained. On the other hand, if the total number exceeds 500, the dimple effect is hardly obtained because the size of the respective dimples 10 is small. The shape (shape in a plan view) of dimples 10 includes, for example, without limitation, a circle, polygonal shapes such as roughly triangular shape, roughly quadrangular shape, roughly pentagonal shape, and roughly hexagonal shape, another irregular shape. The shape of the dimples is employed solely or in combination at least two of them.

After the cover is molded, the mold is opened and the golf ball body is taken out from the mold, and as necessary, the golf ball body is preferably subjected to surface treatments such as deburring, cleaning, and sandblast. If desired, a paint film or a mark may be formed. The paint film preferably has a thickness of, but not limited to, 5 μm or larger, and more preferably 7 μm or larger, and preferably has a thickness of 25 μm or smaller, and more preferably 23 μm or smaller. This is because if the thickness is smaller than 5 μm, the paint film is easy to wear off due to continued use of the golf ball, and if the thickness is larger than 25 μm, the effect of the dimples is reduced, resulting in deteriorating flying performance of the golf ball.

Examples

Hereinafter, the present invention will be described in detail by way of example. The present invention is not limited to examples described below. Various changes and modifications can be made without departing from the spirit and scope of the present invention.

(1) Surface Hardness of Center, Inner Core and Outer Core (Shore D Hardness)

A type P1 auto loading durometer manufactured by Kobunshi Keiki Co., Ltd., provided with a Shore D type spring hardness tester prescribed in ASTM-D2240 standard was used to measure the surface hardness H2 of the center, the surface hardness H4 of the inner core, and the surface hardness H6 of the outer core. Shore D hardness measured at the surfaces of the center, the inner core and the outer core were used as the surface hardness H2 of the center, the surface hardness H4 of the inner core, and the surface hardness H6 of the outer core respectively. The core was cut into two hemispheres to obtain a cut plane, and a Shore D hardness measured at the center of the cut plane was used as the central hardness H1 of the center or the core.

(2) Compression Deformation Amount (mm)

A compression deformation amount of the center, the inner core, the outer core or the golf ball (a shrinking amount of the center, the inner core or the golf ball in the compression direction thereof), when applying a load from an initial load of 98 N to a final load of 1275 N, was measured.

(3) Melt Viscosity Measure by a Flow Tester

The melt viscosity of a pellet-form sample was measured with the following conditions by using a flow characteristics evaluation apparatus (Flow Tester CFT-500D, manufactured by Shimadzu Corporation).

Measuring Conditions

Die length: 1 mm

Die diameter: 1 mm

Load: 294 N

Temperature: 190° C.

(4) Melt Viscosity (Pa·s) Measured by a Brookfield Viscometer

The melt viscosity heated at the temperature of 190° C. was measured by a brookfield viscometer (BL type viscometer available from Tokyo Keiki Inc.). Rotor No. 4 was used at a rotation speed of 6 rpm.

(5) Melt Flow Rate (MFR) (g/10 min)

The MFR was measured using a flow tester (Shimadzu flow tester CFT-100C manufactured by Shimadzu Corporation) in accordance with JIS K7210. The measurement was conducted under the conditions of the measurement temperature 240° C. and the load of 2.16 kg; and the measurement temperature 240° C. and the load of 5 kg.

(6) Slab Hardness (Shore D Hardness)

Sheets with a thickness of about 2 mm were produced using a surrounding layer composition, an intermediate layer composition, or a cover composition, and stored at 23° C. for two weeks. Three or more of these sheets were stacked on one another so as not to be affected by the measuring base on which the sheets were placed, and the stack was measured with a type P1 auto loading durometer manufactured by Kobunshi Keiki Co., Ltd., provided with a Shore D type spring hardness tester prescribed in ASTM-D2240 standard. Herein, the sheets were produced by injection molding in the case of the surrounding layer composition comprising a resin composition as a main component, the intermediate layer composition and the cover composition. In the case of the surrounding layer composition comprising the rubber composition as a main component, the sheets were produced by hot pressing under the conditions of 140° C. to 180° C. for 10 minutes to 60 minutes.

(7) Flexural Modulus (MPa)

(A) Test pieces with a length of 80.0±2 mm, a width of 10.0±0.2 mm, and a thickness of 4.0±0.2 mm were produced by injection molding using a dry pellet of (A) the polyamide resin composition, and immediately stored at 23° C.±2° C. for 24 hours or more in a moisture-proof container. The test pieces were taken out from the moisture-proof container and immediately (within 15 minutes) the flexural modulus of the test pieces were measured according to ISO178. The measurement was conducted at a temperature of 23° C. and a humidity of 50% RH.

(B) Test pieces with a length of 80.0±2 mm, a width of 10.0±0.2 mm, and a thickness of 4.0±0.2 mm were produced by injection molding using (B) the copolymer and/or a metal-neutralized product thereof or the high fluidity intermediate layer composition, and stored at 23° C. for two weeks under the humidity of 50% RH. The flexural modulus of the test pieces were measured according to ISO178. The measurement was conducted at a temperature of 23° C. and a humidity of 50% RH.

(8) Tensile Modulus (MPa)

A sheet with a thickness of about 2 mm was produced by injection molding a high fluidity intermediate layer composition, and stored at 23° C. for two weeks. A dumbbell-shaped test piece was produced from this sheet, and the tensile modulus of the test piece was measured according to ISO 527-1.

(9) Durability for Golf Ball Nos. 1 to 12

A metal-head W#1 driver (XXIO S, loft: 11°, manufactured by SRI Sports Limited) was installed on a swing robot M/C manufactured by Golf Laboratories, Inc. Each golf ball was hit at a head speed of 45 m/sec. This procedure was repeated, and the number of hits required to break the golf ball was counted. It is noted that there was a case where the golf ball looks unbroken but a crack occurs in the intermediate layer. In such a case, whether or not the golf ball was broken was determined based on deformation of the golf ball and difference in sound at hitting of the golf ball.

The number of hits for golf ball No. 8 was defined as an index of 100, and the durability of each golf ball was represented by converting the number of hits for each golf ball into this index. A greater index value indicates that the durability of the golf ball is excellent.

(10) Shot with a Driver

A metal-head W#1 driver (XXIO 5, loft: 11°, manufactured by SRI Sports Limited) was installed on a swing robot M/C manufactured by Golf Laboratories, Inc. A golf ball was hit at a head speed of 50 m/sec, and the speed of the golf ball immediately after the hit, the launch angle, the spin rate, and the flight distance (the distance from the launch point to the stop point) were measured. This measurement was conducted twelve times for each golf ball, and the average value was used as the measurement value for the golf ball. Regarding the speed of the golf ball immediately after the hit and the spin rate, a sequence of photographs of the hit golf ball were taken to measure the spin rate and the initial ball speed.

(11) Shot with an Approach Wedge

A sand wedge was installed on a swing robot M/C manufactured by Golf Laboratories, Inc. A golf ball was hit at a head speed of 21 m/sec. The measurement was conducted twelve times for each golf ball, and the average value was used as the spin rate. Regarding the spin rate of the golf ball immediately after the hitting, a sequence of photographs of the hit golf ball were taken to determine the spin rate. The range of the spin rate is the difference between the maximum value and the minimum value among the spin rates of twelve times. A narrower range of the spin rate indicates that the spin stability is high.

Evaluation Criteria for Range of Spin Rate

A: The range is less than 100 rpm.

B: The range is 100 rpm or more and less than 200 rpm.

C: The range is 200 rpm or more.

(12) Shot Feeling for Golf Ball Nos. 13 to 21

The golf balls were actually hit with an approach club (sand wedge) by ten amateur golfers (high skilled golfers). The shot feelings were ranked into the following criteria, based on the number of the golfers who answered "The impact of the shots is small and resilient and the shot feeling is good."

A: 8 or more golfers

B: 6 to 7 golfers

C: 4 to 5 golfers

D: 3 or less golfers

The results are shown in Tables No. 10 to No. 12.

[Production of Golf Ball No. 1 to No. 12]

(1) Production of Center

Centers were obtained by kneading rubber compositions having the formulations shown in Table 1, and heat-pressing the kneaded material in upper and lower molds, each having a hemispherical cavity, at 170° C. for 30 minutes.

TABLE 1

| | Center No. | A | B |
|---|---|---|---|
| Formulation | Polybutadiene | 100 | 100 |
| | Zinc acrylate | 31.5 | 31.5 |
| | Zinc oxide | 5 | 5 |
| | Barium sulfate | Appropriate amount*) | Appropriate amount*) |
| | Diphenyl disulfide | 0.3 | 0.3 |
| | Dicumyl peroxide | 0.9 | 0.9 |
| Properties | Diameter (mm) | 39.8 | 40.2 |
| | Surface hardness H2 (Shore D hardness) | 60 | 60 |
| | Compression deformation amount (mm) | 2.99 | 2.99 |

Formulation: parts by mass

*)Depending on the cover composition, adjustment was made such that the golf ball had a mass of 45.4 g.

Polybutadiene rubber: "BR-730 (high-cis polybutadiene)" manufactured by JSR Corporation Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation It is noted that an appropriate amount of barium sulfate was added such that the obtained golf ball had a mass of 45.4 g.

(2) Preparation of Cover Composition

Blending materials shown in Table 2 were mixed with a twin-screw kneading extruder to prepare a cover composition in the pellet form. The extruding conditions were a screw diameter of 45 mm, a screw rotational speed of 200 rpm, and screw L/D=35, and the mixtures were heated to 160 to 230° C. at the die position of the extruder.

TABLE 2

| | Cover composition No. | a | b |
|---|---|---|---|
| Formulation | Elastollan XNY 83A | 100 | — |
| | Elastollan XNY 85A | — | 100 |
| | Titanium oxide | 4 | 4 |
| Properties | H7 Slab hardness (Shore D hardness) | 30 | 32 |

Formulation: parts by mass

Elastollan XNY83A: a thermoplastic polyurethane elastomer manufactured by BASF Japan Ltd.

Elastollan XNY85A: a thermoplastic polyurethane elastomer manufactured by BASF Japan Ltd.

(3) Preparation of Intermediate Layer Composition (3-1) Mixing of (A) Component and (B) Component (A) component and (B) component were dry blended with a tumbler type mixer as shown in Tables 3 to 5 to obtain a mixture of (A) component and (B) component. In preparation of golf ball Nos. 1 to 4, 7 to 9, (A) component in a pellet form, which is obtained by previously mixing (a-1) component and (a-2) component, was dry blended with (B) component in a pellet form. In preparation of golf ball Nos. 5, 6, and 12, (a-1) component in a pellet form, (a-2) component in a pellet form, and (B) component in a pellet form were dry blended.

(3-2) Mixing of (A) Component, (B) Component, and (C) Component

With a twin-screw kneading extruder provided with a side feeder, the high fluidity intermediate layer composition in a pellet form was prepared by mixing (A) component and (B) component which were fed through the main feeder, prior to adding a melt of (C) component in a liquid state from the side feeder and mixing them, as shown in Tables 3 to 5. The extruding conditions were a screw diameter of 45 mm, a screw rotational speed of 200 rpm, and screw L/D=35, and the mixtures were heated to 160 to 230° C. at the die position of the extruder. Further, (C) component was melt at the temperature from +10° C. to +30° C. with respect to the melting point of the (C) component.

(4) Production of Golf Ball Body

A spherical core was produced by injection-molding the high fluidity intermediate layer composition onto the center thus obtained to form an intermediate layer covering the center. Then, a golf ball was produced by injection-molding the cover composition onto the spherical core to form a cover. Upper and lower molds have a spherical cavity with pimples, a part of which serves as a hold pin which is extendable and retractable.

When forming the intermediate layer, the hold pins were protruded to hold the center, the intermediate layer composition heated at 260° C. was charged into the mold under a pressure of 80 tons within 0.3 seconds. After cooling for 30 seconds, the mold was opened and the core was discharged.

When forming the cover, the hold pins were protruded to hold the core, the resin heated at 210° C. was charged into the mold under a pressure of 80 tons within 0.3 seconds, and cooled for 30 seconds. Then, the mold was opened, and the golf ball body was taken out from the mold. The surface of the obtained golf ball body was treated with sandblast, marked, and painted with a clear paint. The paint was dried in an oven at 40° C., and golf balls having a diameter of 42.8 mm and a mass of 45.4 g were obtained.

The evaluation results of durability, compression deformation amount, and flight distance or the like about the obtained golf ball are shown in Tables 3 to 5.

TABLE 3

| | Golf ball No. | | | | 1 | 2 | 3 | 4 | 5 |
|---|---|---|---|---|---|---|---|---|---|
| Intermediate layer | Center No. | | | | A | A | B | A | A |
| | Intermediate layer composition | Formulation | (B) | SURLYN 8945 | 20 | 20 | 20 | 20 | 20 |
| | | | | HIMILAN AM7329 | 20 | 20 | 20 | 20 | 20 |
| | | | (a-2) | LOTADER AX8840 | — | — | — | — | 2 |
| | | | (A) NOVAMID ST120 | | 60 | 60 | 60 | 60 | — |
| | | | (a-1) | NOVAMID 1010C2 | — | — | — | — | — |
| | | | | Rilsan B | — | — | — | — | 60 |
| | | | (C) | NUCREL N2050H | 12 | | | | |
| | | | | Magnesium stearate | | 5 | 5 | 15 | 5 |
| | | | Titanium oxide | | 4 | 4 | 4 | 4 | 4 |
| | | (A) | MFR(240° C., 2.16 kg) (g/10 min) | | 30 | 30 | 30 | 30 | 55 |
| | | | Flexural modulus (MPa) | | 2000 | 2000 | 2000 | 2000 | 1000 |
| | | MFR(240° C., 2.16 kg) (g/10 min) | | | 15 | 18 | 18 | 30 | 20 |
| | | H5 Slab Hardness (Shore D) | | | 68 | 70 | 70 | 71 | 70 |
| | | Slab Flexural modulus (MPa) | | | 448 | 653 | 653 | 680 | 575 |

TABLE 3-continued

| Golf ball No. | | | 1 | 2 | 3 | 4 | 5 |
|---|---|---|---|---|---|---|---|
| | Slab Tensile modulus (MPa) | | 702 | 804 | 804 | 840 | 690 |
| | Thickness (mm) | | 1.0 | 1.0 | 0.8 | 1.0 | 1.0 |
| Core | Diameter (mm) | | 41.8 | 41.8 | 41.8 | 41.8 | 41.8 |
| Property | Center hardness H1 (Shore D) | | 42 | 42 | 42 | 42 | 42 |
| | Surface hardness H6 (Shore D) | | 68 | 70 | 70 | 71 | 70 |
| | Compression deformation amount (mm) | | 2.68 | 2.57 | 2.57 | 2.55 | 2.62 |
| Cover | Cover composition No. | | a | a | a | a | a |
| | Thickness (mm) | | 0.5 | 0.5 | 0.5 | 0.5 | 0.5 |
| Body | Compression deformation amount (mm) | | 2.58 | 2.47 | 2.47 | 2.45 | 2.52 |
| evaluation | Durability (Index) | | 110 | 106 | 101 | 105 | 106 |
| | Driver shot | Ball speed (m/s) | 74 | 74 | 74 | 74 | 74 |
| | | Launch angle (°) | 11.4 | 11.4 | 11.3 | 11.4 | 11.4 |
| | | Spin rate (rpm) | 2390 | 2300 | 2330 | 2290 | 2370 |
| | | Flight distance (m) | 250 | 253 | 253 | 253 | 251 |
| | Approach | Spin rate (rpm) | 6500 | 6480 | 6510 | 6490 | 6420 |
| | wedge shot | Spin stability | A | A | A | A | A |

Parts by mass

TABLE 4

| Golf ball No. | | | | | 6 | 7 | 8 | 9 | 10 |
|---|---|---|---|---|---|---|---|---|---|
| Intermediate | Center No. | | | | A | A | A | A | A |
| layer | Intermediate | Formulation | (B) | SURLYN 8945 | 20 | 35 | 10 | 20 | 50 |
| | layer | | | HIMILAN AM7329 | 20 | 35 | 10 | 20 | 50 |
| | composition | | (a-2) | LOTADER AX8840 | 2 | — | — | — | — |
| | | | (A) NOVAMID ST120 | | — | 30 | 80 | 60 | — |
| | | | (a-1) | NOVAMID 1010C2 | — | — | — | — | — |
| | | | | Rilsan B | 60 | — | — | — | — |
| | | | (C) | NUCREL N2050H | — | | | | |
| | | | | Magnesium stearate | 15 | 5 | 5 | — | — |
| | | | Titanium oxide | | 4 | 4 | 4 | 4 | 4 |
| | | (A) | MFR(240° C., 2.16 kg) (g/10 min) | | 55 | 30 | 30 | 30 | — |
| | | | Flexural modulus (MPa) | | 1000 | 2000 | 2000 | 2000 | — |
| | | MFR(240° C., 2.16 kg) (g/10 min) | | | 35 | 25 | 40 | 3.2 | — |
| | | H5 Slab Hardness (Shore D) | | | 72 | 65 | 74 | 68 | 66 |
| | | Slab Flexural modulus (MPa) | | | 580 | 380 | 760 | 602 | 364 |
| | | Slab Tensile modulus (MPa) | | | 710 | 430 | 1200 | 638 | 414 |
| | Thickness (mm) | | | | 1.0 | 1.0 | 1.0 | — | 1.0 |
| Core | Diameter (mm) | | | | 41.8 | 41.8 | 41.8 | NG | 41.8 |
| Property | Center hardness H1 (Shore D) | | | | 42 | 42 | 42 | | 42 |
| | Surface hardness H6 (Shore D) | | | | 72 | 66 | 74 | | 67 |
| | Compression deformation amount (mm) | | | | 2.62 | 2.69 | 2.49 | | 2.70 |
| Cover | Cover composition No. | | | | a | b | a | | b |
| | Thickness (mm) | | | | 0.5 | 0.5 | 0.5 | | 0.5 |
| Body | Compression deformation amount (mm) | | | | 2.52 | 2.59 | 2.39 | | 2.59 |
| Evaluation | Durability (Index) | | | | 100 | 109 | 100 | | 104 |
| | Driver shot | | | Ball speed (m/s) | 74 | 73 | 73 | | 75 |
| | | | | Launch angle (°) | 11.4 | 11.3 | 11.4 | | 11.2 |
| | | | | Spin rate (rpm) | 2350 | 2480 | 2200 | | 2550 |
| | | | | Flight distance (m) | 252 | 249 | 253 | | 248 |
| | Approach | | | Spin rate (rpm) | 6370 | 6600 | 6300 | | 6700 |
| | wedge shot | | | Spin stability | A | A | A | | A |

Parts by mass

TABLE 5

| Golf ball No. | | | | | 11 | 12 |
|---|---|---|---|---|---|---|
| Intermediate | Center No. | | | | A | A |
| layer | Intermediate | Formulation | (B) | SURLYN 8945 | 30 | 20 |
| | layer | | | HIMILAN AM7329 | 30 | 20 |
| | composition | | (a-2) | LOTADER AX8840 | — | 4 |
| | | | (A) NOVAMID ST120 | | — | — |
| | | | (a-1) | NOVAMID 1010C2 | 40 | — |
| | | | | Rilsan B | — | 60 |
| | | | (C) | NUCREL N2050H | — | |
| | | | | Magnesium stearate | — | — |
| | | | Titanium oxide | | 4 | 4 |
| | | (A) | MFR(240° C., 2.16 kg) (g/10 min) | | 50 | 55 |
| | | | Flexural modulus (MPa) | | 2700 | 1000 |

TABLE 5-continued

| Golf ball No. | | | 11 | 12 |
|---|---|---|---|---|
| | MFR(240° C., 2.16 kg) (g/10 min) | | 25 | 0.1 |
| | H5 Slab Hardness (Shore D) | | 71 | 70 |
| | Slab Flexural modulus (MPa) | | 580 | 563 |
| | Slab Tensile modulus (MPa) | | 630 | 660 |
| | Thickness (mm) | | 1.0 | NG |
| Core | Diameter (mm) | | 41.8 | |
| Property | Center hardness H1 (Shore D) | | 42 | |
| | Surface hardness H6 (Shore D) | | 72 | |
| | Compression deformation amount (mm) | | 2.21 | |
| Cover | Cover composition No. | | a | |
| | Thickness (mm) | | 0.5 | |
| Body | Compression deformation amount (mm) | | 2.15 | |
| Evaluation | Durability (Index) | | 3 | |
| | Driver shot | Ball speed (m/s) | 73 | |
| | | Launch angle (°) | 11.3 | |
| | | Spin rate (rpm) | 2300 | |
| | | Flight distance (m) | 242 | |
| | Approach wedge shot | Spin rate (rpm) | 6300 | |
| | | Spin stability | B | |

Parts by mass

Notes on tables 3 to 5

Formulation: parts by mass

NG: Impossible to mold

Surlyn 8945: Sodium ion neutralized ethylene-methacrylic acid copolymer ionomer resin (Melt viscosity (190° C.) measured by a flow tester: 1,000 Pa · s) available from E. I. du Pont de Nemours and Company Himilan AM7329: Zinc ion neutralized ethylene-methacrylic acid copolymer ionomer resin (Melt viscosity (190° C.) measured by a flow tester: 1,100 Pa · s) available from Du Pont-Mitsui Polychemicals Co., Ltd Nucrel 2050H: ethylene-methacrylic acid copolymer (melt viscosity (190° C.) measured by a flow tester: 8 Pa · s, melt flow rate (190° C.*2.16 kg): 500 g/10 min) available from Du Pont-Mitsui Polychemicals Co., Ltd.

Magnesium stearate: Yoneyama Yakuhin Kogyo CO., LTD

LOTADER AX8840: an ethylene-acrylic acid-glycidyl methacrylate copolymer (amount of monomer containing a polar functional group: 8 mass %) available from Tokyo Zairyo Co., Ltd.

NOVAMID ST120: a mixed resin of polyamide 6 and a resin having at least one functional group selected from the group consisting of a hydroxyl group, a carboxyl group, an anhydride group, a sulfonic acid group, and an epoxy group (including a glycidyl group), (flexural modulus: 2,000 MPa, melt flow rate (240° C., 2.16 kg): 30 g/10 min) available from Mitsubishi Engineering-Plastics Company.

Rilsan B: Rilsan BMF available from Arkema Inc.

NOVAMID 1010C2: polyamide 6 (flexural modulus: 2,900 MPa, melt flow rate (240° C., 2.16 kg): 50 g/10 min) available from Mitsubishi Engineering-Plastics Company.

Each of Golf balls No. 1 to 8 is the case that the intermediate layer is formed from the high fluidity intermediate layer composition containing (A) component, (B) component and (C) component as a resin component. It is obvious that these golf balls No. 1 to 8 have improved flight distance as compared to golf ball No. 10 that includes an intermediate layer formed from an intermediate layer composition consisting of an ionomer resin as a resin component.

Golf ball No. 9 is the case that the mixed resin of polyamide and a resin having at least one functional group selected from the group consisting of a hydroxyl group, a carboxyl group, an anhydride group, a sulfonic acid group, and an epoxy group (including a glycidyl group) has a melt flow rate (240° C., 2.16 kg) less than 5.0 g/10 min. The fluidity of the intermediate layer composition was low, and it was impossible to mold the intermediate layer. Golf ball No. 11 is the case that the intermediate layer is formed from the intermediate layer composition containing an ionomer resin and a polyamide resin as a resin component. If compared with golf ball No. 10, the flight distance was not improved and the durability was not at a practical level. Golf ball No. 12 is the case that the intermediate layer composition does not contain (C) component. The intermediate layer composition had a high flexural modulus, but had a low MFR. Since the fluidity was low, it was impossible to mold the intermediate layer.

[Production of Golf Ball No. 13 to No. 21]

(1) Production of Center

Centers were obtained by kneading rubber compositions having the formulation shown in Table 6, and heat-pressing the kneaded material in upper and lower molds, each having a hemispherical cavity, at 170° C. for 30 minutes.

TABLE 6

| Center Composition No. | | 1 | 2 | 3 |
|---|---|---|---|---|
| Formulation | Polybutadiene | 100 | 100 | 100 |
| | Zinc acrylate | 20 | 36 | 40 |
| | Zinc oxide | 10 | 10 | 10 |
| | Barium sulfate | Appropriate Amount*) | Appropriate Amount*) | Appropriate Amount*) |
| | Diphenyl disulfide | 0.5 | 0.5 | 0.5 |
| | Dicumyl peroxide | 0.8 | 0.8 | 0.8 |

Formulation: parts by mass

*)The amount of Barium sulfate was adjusted such that the golf ball had a mass of 45.4 g.

Polybutadiene rubber: "BR-730 (high-cis polybutadiene)" manufactured by JSR Corporation.

Zinc acrylate: "ZNDA-90S" manufactured by Ninon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

It is noted that an appropriate amount of barium sulfate was added such that the obtained golf ball had a mass of 45.4 g.

(2) Preparation of the Surrounding Layer Composition

Blending materials shown in table 7 were mixed with an twin-screw extruder to obtain the surrounding layer compositions No. b in the pellet form. The extruding conditions were a screw diameter of 45 mm, a screw rotational speed of 200 rpm, and screw L/D=35, and the mixtures were heated to 160 to 230° C. at the die position of the extruder.

TABLE 7

| Surrounding layer Composition No. | | a | b |
|---|---|---|---|
| Formulation (Parts) | Polybutadiene | 100 | — |
| | Zinc acrylate | 38 | — |
| | Zinc oxide | 5 | — |
| | Barium sulfate | 5 | — |
| | Diphenyl disulfide | 0.5 | — |
| | Dicumyl peroxide | 0.8 | — |
| | Himilan 1605 | — | 40 |
| | Himilan 1706 | — | 40 |
| | Surlyn 8140 | — | — |
| | Surlyn 9120 | — | — |
| | Rabalon T3221C | — | 20 |
| H2 Slab hardness (Shore D) | | 56 | 55 |

Formulation: parts by mass

Notes on table 7

Polybutadiene rubber: "BR-730 (high-cis polybutadiene)" manufactured by JSR Corporation.

Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

Himilan 1605: Sodium ion neutralized ethylene-methacrylic acid copolymer ionomer resin available from Du Pont-Mitsui Polychemicals Co., Ltd Himilan 1706: Zinc ion neutralized ethylene-methacrylic acid copolymer ionomer resin available from Du Pont-Mitsui Polychemicals Co., Ltd SURLYN 8140: a sodium ion neutralized ethylene-methacrylic acid copolymer ionomer resin available from E. I. du Pont de Nemours and Company.

SURLYN 9120: a zinc ion neutralized ethylene-methacrylic acid copolymer ionomer resin available from E. I. du Pont de Nemours and Company.

Rabalon T3221C: Polystyrene elastomer available from Mitsubishi Chemical Corporation.

(3) Preparation of Cover Composition and High Fluidity Intermediate Layer Composition Blending materials shown in Tables 8, 10 and 11 were mixed with a twin-screw kneading extruder to prepare cover compositions in the pellet form and high fluidity intermediate layer compositions in the pellet form, respectively. The extruding conditions were a screw diameter of 45 mm, a screw rotational speed of 200 rpm, and screw L/D=35, and the mixtures were heated to 160 to 230° C. at the die position of the extruder.

TABLE 8

| Cover composition No. | X | Y | Z | W |
|---|---|---|---|---|
| Elastollan XNY85A | 100 | — | 20 | — |
| Elastollan XNY97A | — | 100 | 80 | — |
| Elastollan XNY80A | — | — | — | 100 |
| Titanium oxide | 4 | 4 | 4 | 4 |
| H7 Slab hardness(Shore D) | 32 | 48 | 44 | 27 |

Formulation: parts by mass

Elastollan XNY85A: a thermoplastic polyurethane elastomer manufactured by BASF Japan Ltd.(Shore D: 32)

Elastollan XNY97A: a thermoplastic polyurethane elastomer manufactured by BASF Japan Ltd.(Shore D: 47)

Elastollan XNY80A: a thermoplastic polyurethane elastomer manufactured by BASF Japan Ltd.(Shore D: 27)

(4) Production of Golf Ball Body

The centers obtained above were covered with the surrounding layer composition to form the surrounding layer and obtain inner cores. In the case of using the surrounding layer compositions No. b, the surrounding layer was formed by directly injection-molding the surrounding layer compositions onto the center. In the case of using the surrounding layer composition No. a, the surrounding layer composition shown in Table 7 was first kneaded and the upper die for molding a center in the state that the center was set therein and a lower die for molding a core were clamped in a manner that a necessary amount of the surrounding layer composition was brought into contact with a half of the surface of the center and heat pressing was carried out to produce an intermediate core molded product having an surrounding layer formed on a half of the surface of the center. Next, the lower die for molding the core in the state that the surrounding layer of the intermediate core molded product was housed and an upper die for molding a core were clamped in a manner that a necessary amount of the surrounding layer composition was brought into contact with the other half of the surface of the center and heat pressing was carried out to produce a core having a surrounding layer on the other half of the surface of the center. Then, the core was heat pressed at the temperature of 170° C. for 30 minutes to form an inner core.

The intermediate layer compositions obtained above were injection-molded onto the spherical inner cores to form the intermediate layers covering the inner cores. Subsequently, golf balls were produced by injection molding or compression molding. In the injection molding method, the cover composition was directly injection-molded onto the intermediate layer to form a cover. In the compression molding, the cover composition was molded into half hells by injection-molding or compression-molding, and the inner core formed with the intermediate layer was covered with the two half shells and then subjected to the heat-pressing. Upper and lower molds have a spherical cavity with pimples, a part of which serves as a hold pin which is extendable and retractable. The hold pins were protruded to hold the core, the resin heated at 210° C. was charged into the mold under a pressure of 80 tons within 0.3 seconds, and cooled for 30 seconds. Then, the mold was opened, and the golf ball body were taken out from the mold.

The surface of the obtained golf ball body were treated with sandblast, marked, and painted with a clear paint. The paint was dried in an oven at 40° C. for 4 hours, and golf balls having a diameter of 42.7 mm and a mass of 45.4 g were obtained.

Figure 4:
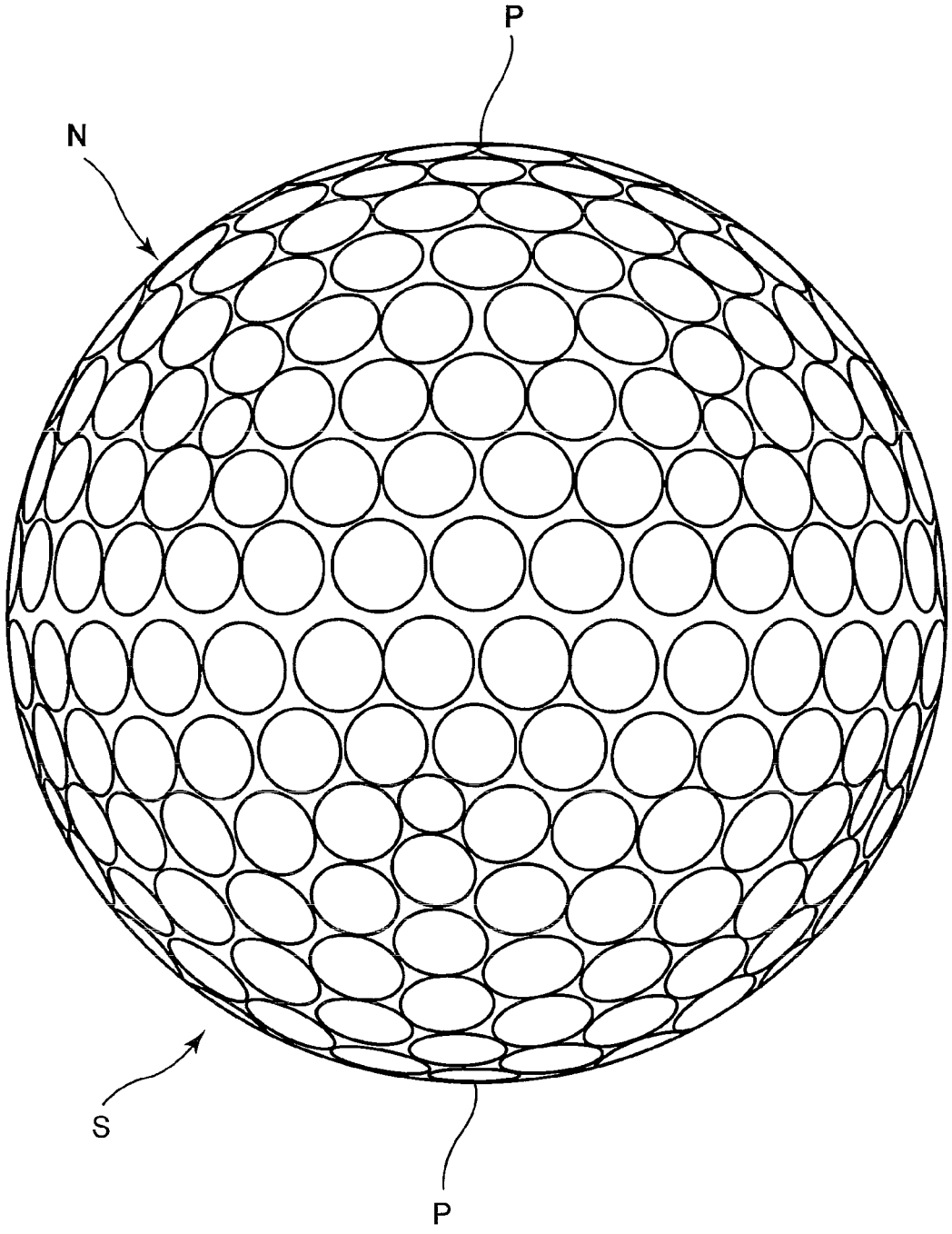
FIG. 4 is a front view of the dimple pattern formed on the surface of the golf ball.
Figure 5:
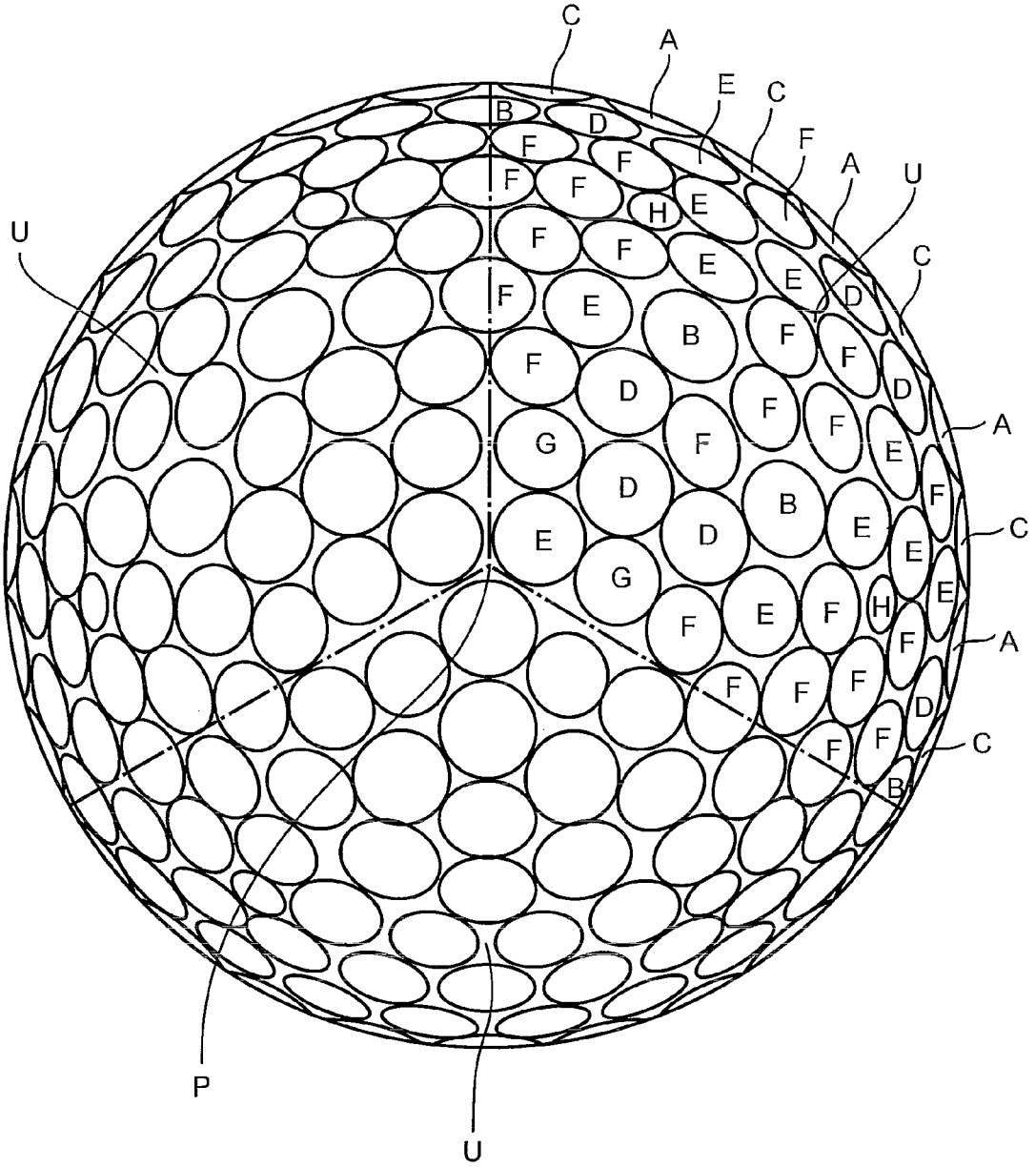
FIG. 5 is a top plan view of the dimple pattern formed on the surface of the golf ball.

The dimple patterns shown in table 9 and FIG. 4 and FIG. 5 were formed on the surface of the golf ball. In the north hemisphere N and south hemisphere S of the golf ball, there is a unit U which has rotational symmetries through 120 degrees. In each of the north hemisphere N and the south hemisphere S, there are three units U. FIG. 5 shows kinds of dimples by represented symbols A to H in one unit U. In table 4, "diameter" of the dimple is depicted by Di in FIG. 3 and "depth" means a distance between the tangential line T and the deepest portion De. P means Pole in FIG. 4.

TABLE 9

| Kinds | Number | Diameter (mm) | Depth (mm) | Curvature radius (mm) | Volume ($mm^3$) | Front view | Plan view |
|---|---|---|---|---|---|---|---|
| A | 24 | 4.75 | 0.140 | 20.22 | 1.242 | FIG. 4 | FIG. 5 |
| B | 18 | 4.65 | 0.140 | 19.38 | 1.190 | | |
| C | 30 | 4.55 | 0.135 | 19.24 | 1.099 | | |
| D | 42 | 4.45 | 0.135 | 18.40 | 1.051 | | |
| E | 66 | 4.25 | 0.135 | 16.79 | 0.959 | | |

TABLE 9-continued

| Kinds | Number | Diameter (mm) | Depth (mm) | Curvature radius (mm) | Volume ($mm^3$) | Front view | Plan view |
|---|---|---|---|---|---|---|---|
| F | 126 | 4.05 | 0.130 | 15.84 | 0.839 | | |
| G | 12 | 3.95 | 0.130 | 15.07 | 0.798 | | |
| H | 12 | 2.80 | 0.120 | 8.23 | 0.370 | | |

The golf balls were evaluated with respect to the durability, compression deformation amount, and the flight distance. The results of evaluations were also shown in tables 10 to 11.

TABLE 10

| Golf ball No. | | | | 13 | 14 | 15 | 16 | 17 |
|---|---|---|---|---|---|---|---|---|
| Inner Core | Center composition No. | | | 1 | 2 | 1 | 2 | 2 |
| | Center Diameter (mm) | | | 20.1 | 38.1 | 20.1 | 37.7 | 37.7 |
| | Compression deformation amount (mm) | | | 5.8 | 3.1 | 5.8 | 3.1 | 3.1 |
| | Surrounding layer composition No. | | | a | b | a | b | b |
| | Surrounding layer thickness (mm) | | | 10.0 | 1.0 | 10.1 | 1.0 | 1.0 |
| | Diameter (mm) | | | 40.1 | 40.1 | 40.3 | 39.7 | 39.7 |
| | Center hardness H1 (Shore D) | | | 30 | 43 | 30 | 43 | 43 |
| | Surface hardness H4 (Shore D) | | | 62 | 58 | 62 | 58 | 58 |
| Intermediate layer composition | Formulation (parts) | (A) | NOVAMID ST120 | 60 | 60 | 60 | — | 30 |
| | | (a-1) | RILSAN B | — | — | — | 60 | — |
| | | (a-2) | LOTADER AX8840 | — | — | — | 2 | — |
| | | (B) | SURLYN 8945 | 20 | 20 | 20 | 20 | 35 |
| | | | HIMILAN AM7329 | 20 | 20 | 20 | 20 | 35 |
| | | (C) | NUCREL N2050H | 12 | 12 | — | — | — |
| | | | Magnesium stearate | — | — | 5 | 5 | 5 |
| | | Titanium oxide | | 4 | 4 | 4 | 4 | 4 |
| | (A) | MFR (240° C., 2.16 kg) (g/10 min) | | 30 | 30 | 30 | 55 | 30 |
| | | Flexural modulus (MPa) | | 2000 | 2000 | 2000 | 1000 | 2000 |
| | Properties | H5 Slab hardness (Shore D) | | 68 | 68 | 70 | 67 | 65 |
| | | Flexural modulus (MPa) | | 448 | 448 | 653 | 400 | 410 |
| | | Tensile modulus (MPa) | | 702 | 702 | 804 | 560 | 590 |
| | | MFR (240° C., 2.16 kg) (g/10 min) | | 15 | 15 | 18 | 20 | 25 |
| | Intermediate layer thickness (mm) | | | 0.8 | 0.8 | 0.8 | 1.0 | 1.0 |
| | Surface hardness H6 (Shore D) | | | 70 | 70 | 72 | 69 | 68 |
| Cover | Cover composition No. | | | X | X | W | X | Z |
| | Cover slab hardness H7 (Shore D) | | | 32 | 32 | 27 | 32 | 44 |
| | Thickness (mm) | | | 0.5 | 0.5 | 0.4 | 0.5 | 0.5 |
| Golf ball evaluation | Compression deformation amount (mm) | | | 2.35 | 2.4 | 2.3 | 2.4 | 2.4 |
| | Flight distance on driver shot (m) | | | 252.0 | 251.5 | 253.5 | 252.0 | 250.5 |
| | Spin rate on driver shot (rpm) | | | 2580 | 2600 | 2540 | 2530 | 2590 |
| | Spin rate on short iron shot (rpm) | | | 6570 | 6550 | 6597 | 6523 | 6496 |
| | Shot feeling | | | E | E | G | E | E |

TABLE 11

| Golf ball No. | | | | 18 | 19 | 20 | 21 |
|---|---|---|---|---|---|---|---|
| Inner Core | Center composition No. | | | 1 | 2 | 1 | 3 |
| | Center Diameter (mm) | | | 20.1 | 37.7 | 20.1 | 39.7 |
| | Compression deformation amount (mm) | | | 5.8 | 3.1 | 5.8 | 2.7 |
| | Surrounding layer composition No. | | | a | b | a | — |
| | Surrounding layer thickness (mm) | | | 9.8 | 1.0 | 10.0 | — |
| | Diameter (mm) | | | 39.7 | 39.7 | 40.1 | 39.7 |
| | Center hardness H1 (Shore D) | | | 30 | 43 | 30 | 50 |
| | Surface hardness H4 (Shore D) | | | 62 | 58 | 62 | — |
| Intermediate layer composition | Formulation (parts) | (A) | NOVAMID ST120 | — | 60 | 60 | — |
| | | (a-1) | RILSAN B | — | — | — | 60 |
| | | (a-2) | LOTADER AX8840 | — | — | — | 2 |
| | | (B) | SURLYN 8945 | 50 | 20 | 20 | 20 |
| | | | HIMILAN AM7329 | 50 | 20 | 20 | 20 |
| | | (C) | NUCREL N2050H | — | — | — | — |
| | | | Magnesium stearate | — | — | 5 | 5 |
| | | Titanium oxide | | 4 | 4 | 4 | 4 |
| | (A) | MFR (240° C., 2.16 kg) (g/10 min) | | — | 30 | 30 | 55 |
| | | Flexural modulus (MPa) | | — | 2000 | 2000 | 1000 |

TABLE 11-continued

| Golf ball No. | | | 18 | 19 | 20 | 21 |
|---|---|---|---|---|---|---|
| | Properties | H5 Slab hardness (Shore D) | 65 | 69 | 70 | 67 |
| | | Flexural modulus (MPa) | 282 | 602 | 653 | 400 |
| | | Tensile modulus (MPa) | 380 | 638 | 804 | 560 |
| | | MFR (240° C., 2.16 kg) (g/10 min) | — | 3.2 | 18 | 20 |
| | Intermediate layer thickness (mm) | | 1.0 | NG | 0.8 | 1.0 |
| | Surface hardness H6 (Shore D) | | 68 | | 72 | 69 |
| Cover | Cover composition No. | | X | | Y | X |
| | Cover slab hardness H7 (Shore D) | | 32 | | 48 | 32 |
| | Thickness (mm) | | 0.5 | | 0.5 | 0.5 |
| Golf ball | Compression deformation amount (mm) | | 2.4 | | 2.3 | 2.4 |
| evaluation | Flight distance on driver shot (m) | | 249.0 | | 254.5 | 249.0 |
| | Spin rate on driver shot (rpm) | | 2630 | | 2420 | 2680 |
| | Spin rate on short iron shot (rpm) | | 6581 | | 6246 | 6640 |
| | Shot feeling | | E | | P | G |

Notes on Table 10 to 11
Formulation: parts by mass
NG: Golf ball was broken by only one shot.

Details of the Materials are Shown on Notes of Table 3 to 5.

Golf balls No. 13 to 17 are the cases that the intermediate layer is formed from the high fluidity intermediate layer composition and that the surface hardness H6 of the intermediate layer is equal to or larger than the surface hardness H4 of the inner core (H6≥H4) and the hardness H7 of the cover is 45 or less in Shore D hardness. It is obvious that these golf balls No. 13 to 17 have improved flight distance, while maintaining the spin rate on the shots with a short iron and the shot feeling, as compared to golf ball No. 18 that includes an intermediate layer formed from an intermediate layer composition consisting of an ionomer resin as a resin component.

Golf ball No. 19 is the case that the intermediate layer composition does not contain (C) component. The intermediate layer composition had a high flexural modulus, but had a low MFR. Since the fluidity was low, it was impossible to mold the intermediate layer. Golf ball No. 20 is the case that the cover has a hardness H7 of more than 45 in Shore D hardness and was inferior with respect to the spin rate on the shots with short irons, shot feeling, and durability. Golf ball No. 21 is the case that the core is a single-layered core without the surrounding layer and was inferior with respect to the flight distance.

The present invention relates to the golf ball, especially useful for the golf ball excellent in the flight distance. The present invention can be also applied to the golf ball which strikes a balance between the flight distance on the driver shots and the approach performance on the approach shots while providing the excellent shot feeling. This application is based on Japanese Patent application No. 2008-335261 filed on Dec. 26, 2008, and Japanese Patent application No. 2008-335265 filed on Dec. 26, 2008, the contents of which are hereby incorporated by reference.

The invention claimed is:

1. A golf ball comprising:

core having a center and at least one intermediate layer covering the center; and a cover covering the core, wherein at least one piece or one layer of the intermediate layer is formed from a high fluidity intermediate layer composition that has a slab hardness of 65 or more in Shore D hardness and a tensile modulus in a range from 400 MPa to 2000 MPa and contains (A) a polyamide resin composition having a flexural modulus in a range from 700 MPa to 4,000 MPa, and containing (a-1) a polyamide resin and (a-2) a thermoplastic elastomer;

(B) at least one member selected from the group consisting of a metal-neutralized product of an ethylene-(meth)acrylic acid binary copolymer and a metal-neutralized product of an ethylene-(meth)acrylic acid-(meth)acrylic acid ester ternary copolymer, and (C) a fluidity improving agent, wherein (a-1) the polyamide resin is at least one selected from the group consisting of polyamide 6, polyamide 11, polyamide 12, polyamide 66, polyamide 610, polyamide 6T, polyamide 9T, polyamide M5T, polyamide 612 and a polyetherblock amide copolymer, (a-2) the thermoplastic elastomer contains at least one member selected from the group consisting of:

a thermoplastic polyolefin elastomer having at least one functional group selected from the group consisting of a hydroxyl group, a carboxyl group, an anhydride group, a sulfonic acid group, and an epoxy group;

a thermoplastic polyamide elastomer having at least one functional group selected from the group consisting of a hydroxyl group, a carboxyl group, an anhydride group, a sulfonic acid group, and an epoxy group;

a thermoplastic polyurethane elastomer having at least one functional group selected from the group consisting of a hydroxyl group, a carboxyl group, an anhydride group, a sulfonic acid group, and an epoxy group; and a thermoplastic polystyrene elastomer having at least one functional group selected from the group consisting of a hydroxyl group, a carboxyl group, an anhydride group, a sulfonic acid group, and an epoxy group, the component (B) is neutralized with at least one metal selected from the group consisting of Li, Na, Ca, Zn, Mg and Cu, (C) the fluidity improving agent includes at least one selected from the group consisting of a fatty acid, a metal salt thereof, a nonionic thermoplastic resin having a melt viscosity (190° C.) ranging from 5 Pa·s to 1,000 Pa·s measured by a flow tester, and an ionomer resin having a melt viscosity (190° C.) ranging from 1 Pa·s to 10 Pa·s measured by a brookfield viscometer, a content ratio ((A)/(B)) of (A) component to (B) component (a total is 100 mass %) in the high fluidity intermediate layer composition is 20 mass % to 80 mass %/80 mass % to 20 mass %, and a blending amount of (C) the fluidity improving agent in the high fluidity intermediate layer composition is from 1 part to 30 parts by mass with respect to 100 parts by mass of a sum of (A) component and (B) component, the intermediate layer has a thickness in a range from 0.8 mm to 2.0 mm, the core has a hardness difference (H6–H1) between a core surface hardness H6 and a core center hardness H1 in a range of from 10 to 55 in Shore D, and the center has a center surface hardness H2 of 64 or less in Shore D hardness.

2. The golf ball according to claim 1, further comprising a surrounding layer between the center and the intermediate layer.

3. A golf ball comprising:

a core having a center and at least one intermediate layer covering the center; and a cover covering the core, wherein at least one piece or one layer of the intermediate layer is formed from a high fluidity intermediate layer composition that has a slab hardness of 65 or more in Shore D hardness and a tensile modulus in a range from 400 MPa to 2000 MPa and contains (A) a polyamide resin composition having a flexural modulus in a range from 700 MPa to 4,000 MPa and a melt flow rate (240° C., 2.16 kg) of 5.0 g/10 min or more, and containing (a-1) a polyamide resin and (a-2) a thermoplastic elastomer;

(B) at least one member selected from the group consisting of a metal-neutralized product of an ethylene-(meth)acrylic acid binary copolymer and a metal-neutralized product of an ethylene-(meth)acrylic acid-(meth)acrylic acid ester ternary copolymer; and (C) a fluidity improving agent, wherein (a-1) the polyamide resin is at least one selected from the group consisting of polyamide 6, polyamide 11, polyamide 12, polyamide 66, polyamide 610, polyamide 6T, polyamide 9T, polyamide M5T, polyamide 612 and a polyetherblock amide copolymer;

(a-2) the thermoplastic elastomer contains at least one member selected from the group consisting of:

a thermoplastic polyolefin elastomer having at least one functional group selected from the group consisting of a hydroxyl group, a carboxyl group, an anhydride group, a sulfonic acid group, and an epoxy group;

a thermoplastic polyamide elastomer having at least one functional group selected from the group consisting of a hydroxyl group, a carboxyl group, an anhydride group, a sulfonic acid group, and an epoxy group;

a thermoplastic polyurethane elastomer having at least one functional group selected from the group consisting of a hydroxyl group, a carboxyl group, an anhydride group, a sulfonic acid group, and an epoxy group; and a thermoplastic polystyrene elastomer having at least one functional group selected from the group consisting of a hydroxyl group, a carboxyl group, an anhydride group, a sulfonic acid group, and an epoxy group, the component (B) is neutralized with at least one metal selected from the group consisting of Li, Na, Ca, Zn, Mg and Cu, (C) the fluidity improving agent includes at least one selected from the group consisting of a fatty acid, a metal salt thereof, a nonionic thermoplastic resin having a melt viscosity (190° C.) ranging from 5 Pa·s to 1,000 Pa·s measured by a flow tester, and an ionomer resin having a melt viscosity (190° C.) ranging from 1 Pa·s to 10 Pa·s measured by a brookfield viscometer, a content ratio ((A)/(B)) of (A) component to (B) component (a total is 100 mass %) in the high fluidity intermediate layer composition is 20 mass % to 80 mass %/80 mass % to 20 mass %, and a blending amount of (C) the fluidity improving agent in the high fluidity intermediate layer composition is from 1 part to 30 parts by mass with respect to 100 parts by mass of a sum of (A) component and (B) component, the intermediate layer has a thickness in a range from 0.8 mm to 2.0 mm, the core has a hardness difference (H6–H1) between a core surface hardness H6 and a core center hardness H1 in a range of from 10 to 55 in Shore D, and the center has a center surface hardness H2 of 64 or less in Shore D hardness.

4. The golf ball according to claim 3, wherein the high fluidity intermediate layer composition has a melt flow rate (240° C., 2.16 kg) in a range from 5.0 g/10 min to 50.0 g/10 min.

5. The golf ball according to claim 3, wherein the high fluidity intermediate layer composition has a flexural modulus in a range from 350 MPa to 1,000 MPa, and a slab hardness in a range from 65 to 75 in Shore D hardness.

6. The golf ball according to claim 3, wherein the thermoplastic elastomer is a thermoplastic polystyrene elastomer.

7. A golf ball comprising:

an inner core consisting of a center and a surrounding layer covering the center, at least one intermediate layer covering the inner core, and a cover covering the intermediate layer, wherein at least one piece or one layer of the intermediate layer is formed from a high fluidity intermediate layer composition that has a melt flow rate (240° C., 2.16 kg) of 5.0 g/10 min or more, a slab hardness of 65 or more in Shore D hardness and a tensile modulus in a range from 400 MPa to 2000 MPa and contains;

(A) a polyamide resin composition having a flexural modulus in a range from 700 MPa to 4,000 MPa, and containing (a-1) a polyamide resin and (a-2) a thermoplastic elastomer;

(B) at least one member selected from the group consisting of a metal-neutralized product of an ethylene-(meth)acrylic acid binary copolymer and a metal-neutralized product of an ethylene-(meth)acrylic acid-(meth)acrylic acid ester ternary copolymer; and (C) a fluidity improving agent, wherein (a-1) the polyamide resin is at least one selected from the group consisting of polyamide 6, polyamide 11, polyamide 12, polyamide 66, polyamide 610, polyamide 6T, polyamide 9T, polyamide M5T, polyamide 612 and a polyetherblock amide copolymer, (a-2) the thermoplastic elastomer contains at least one member selected from the group consisting of:

a thermoplastic polyolefin elastomer having at least one functional group selected from the group consisting of a hydroxyl group, a carboxyl group, an anhydride group, a sulfonic acid group, and an epoxy group;

a thermoplastic polyamide elastomer having at least one functional group selected from the group consisting of a hydroxyl group, a carboxyl group, an anhydride group, a sulfonic acid group, and an epoxy group;

a thermoplastic polyurethane elastomer having at least one functional group selected from the group consisting of a hydroxyl group, a carboxyl group, an anhydride group, a sulfonic acid group, and an epoxy group; and a thermoplastic polystyrene elastomer having at least one functional group selected from the group consisting of a hydroxyl group, a carboxyl group, an anhydride group, a sulfonic acid group, and an epoxy group, the component (B) is neutralized with at least one metal selected from the group consisting of Li, Na, Ca, Zn, Mg and Cu, (C) the fluidity improving agent includes at least one selected from the group consisting of a fatty acid, a metal salt thereof, a nonionic thermoplastic resin having a melt viscosity (190° C.) ranging from 5 Pa·s to 1,000 Pa·s measured by a flow tester, and an ionomer resin having a melt viscosity (190° C.) ranging from 1 Pa·s to 10 Pa·s measured by a brookfield viscometer, a content ratio ((A)/(B)) of (A) component to (B) component (a total is 100 mass %) in the high fluidity intermediate layer composition is 20 mass % to 80 mass %/80 mass % to 20 mass %, and a blending amount of (C) the fluidity improving agent in the high fluidity intermediate layer composition is from 1 part to 30 parts by mass with respect to 100 parts by mass of a sum of (A) component and (B) component, a surface hardness (H6) of the intermediate layer and a surface hardness (H4) of the inner core satisfy the equation: H6≥H4, and the cover has a slab hardness (H7) of 45 or less in Shore D hardness, and wherein the intermediate layer has a thickness in a range from 0.8 mm to 2.0 mm, the inner core has a hardness difference (H4−H1) between an inner core surface hardness H4 and an inner core center hardness H1 in a range of from 10 to 55 in Shore D, and the inner core has an inner core surface hardness H4 of 63 or less in Shore D hardness.

8. The golf ball according to claim 7, wherein the inner core has a surface hardness (H4) from 45 to 63 in Shore D hardness.

9. The golf ball according to claim 7, wherein the high fluidity intermediate layer composition has a flexural modulus in a range from 400 MPa to 1,000 MPa, and a slab hardness in range from 65 to 75 in Shore D hardness.

10. The golf ball according to claim 7, wherein the cover has a thickness of 0.8 mm or less.

11. The golf ball according to claim 7, wherein a hardness difference (H6−H4) between the surface hardness (H6) of the intermediate layer and the surface hardness (H4) of the inner core ranges from 3 to 25 in Shore D hardness.

* * * * *